US008020959B2

(12) United States Patent
Yamashiro et al.

(10) Patent No.: US 8,020,959 B2
(45) Date of Patent: Sep. 20, 2011

(54) IMAGE FORMING APPARATUS, IMAGE FORMING METHOD, AND CONTROL PROGRAM FOR CONTROLLING A CARRIAGE UPON CONVEYANCE FAILURE

(75) Inventors: Toshihiro Yamashiro, Yokohama (JP); Shigeru Yoshigai, Sagamihara (JP); Yoshimitsu Ogura, Isehara (JP); Tetsuyoshi Nakata, Hadano (JP)

(73) Assignee: Ricoh Company, Ltd., Tokyo (JP)

( * ) Notice: Subject to any disclaimer, the term of this patent is extended or adjusted under 35 U.S.C. 154(b) by 509 days.

(21) Appl. No.: 12/219,717

(22) Filed: Jul. 28, 2008

(65) Prior Publication Data

US 2009/0028586 A1 Jan. 29, 2009

(30) Foreign Application Priority Data

Jul. 27, 2007 (JP) ..... 2007-196254

(51) Int. Cl.
*B41J 29/38* (2006.01)
*B41J 23/00* (2006.01)

(52) U.S. Cl. ..... 347/16; 347/37; 347/104

(58) Field of Classification Search ..... 347/16
See application file for complete search history.

(56) References Cited

U.S. PATENT DOCUMENTS

| | | | | |
|---|---|---|---|---|
| 5,870,114 | A * | 2/1999 | Numata et al. | 347/16 |
| 6,390,698 | B1 * | 5/2002 | Yoshida et al. | 400/356 |
| 7,334,884 | B2 | 2/2008 | Shiota | |
| 2005/0007437 | A1 | 1/2005 | Shiota | |
| 2005/0175388 | A1 * | 8/2005 | Namekawa et al. | 347/104 |
| 2006/0192804 | A1 | 8/2006 | Nakata et al. | |
| 2009/0237744 | A1 * | 9/2009 | Ogura et al. | 358/448 |

FOREIGN PATENT DOCUMENTS

| | | | |
|---|---|---|---|
| CN | 1550335 | | 12/2004 |
| EP | 1 790 487 | | 5/2007 |
| JP | 2002210944 | A * | 7/2002 |
| JP | 2004-280076 | | 10/2004 |
| JP | 2006021370 | A * | 1/2006 |
| WO | WO 2004/106075 | | 12/2004 |

OTHER PUBLICATIONS

Machine generated English translation of Japanese patent document JP 2006-021370A to Mukoyama, Kiyoshi entitled "Inkjet Type Printer"; 8 pgs. retrieved Dec. 22, 2010.*

Machine generated English translation of Japanese patent document JP 2002-210944A to Yokota, Shoji entitled "Printer"; 6 pgs. retrieved Dec. 22, 2010.*

Office Action dated Jun. 29, 2010 in corresponding Chinese Application No. 200810134034.4.

Office Action dated Sep. 11, 2009 in corresponding Chinese Application No. 200810134034.4.

* cited by examiner

*Primary Examiner* — Shelby Fidler
(74) *Attorney, Agent, or Firm* — Harness, Dickey & Pierce, P.L.C.

(57) ABSTRACT

An image forming apparatus, an image forming method, and a control program therefor. The apparatus includes an image processing control unit to process image information sent from an external device, a carriage to move in a main scanning direction according to a control signal sent from the image processing control unit and having a nozzle to discharge an ink onto a recording medium, a conveyance unit to convey the recording medium in a sub-scanning direction, and a conveyance failure detection unit to detect a status of the recording medium. The image processing control unit identifies a type of a conveyance failure among a plurality of types of conveyance failures based on the status of the recording medium output from the conveyance failure detection unit and sends a conveyance failure correction signal to perform an operation for retracting the carriage to a predetermined or desired position in the main scanning direction.

15 Claims, 23 Drawing Sheets

IMAGE FORMING APPARATUS, IMAGE FORMING METHOD, AND CONTROL PROGRAM FOR CONTROLLING A CARRIAGE UPON CONVEYANCE FAILURE

PRIORITY STATEMENT

This patent specification is based on and claims priority from Japanese Patent Application No. 2007-196254, filed on Jul. 27, 2007 in the Japan Patent Office, the entire contents of which are hereby incorporated by reference herein.

BACKGROUND

1. Field

Example embodiments relate to an image forming apparatus, an image forming method, and a control program therefor.

2. Description of the Related Art

There is an image forming apparatus known for forming an image on a recording medium according to image information by discharging ink droplets while a control unit moves a carriage in a main scanning direction and the recording medium in a sub-scanning direction, respectively.

One problem with such an image forming apparatus is that when a recording medium, or paper is jammed, e.g., when a conveyance failure occurs, further movement of the carriage causes an excessive load on the carriage and surrounding components.

There is an image forming apparatus that guides a user to remove the jammed paper by informing the user of an occurrence of the conveyance failure (jam) and how to remove the jammed paper.

In this case, however, removal of the jammed paper depends on user determination or user operation. The user may forcibly move the carriage to remove the jammed paper, pull out the jammed paper without moving the carriage, or contact mechanism components such as an encoder, thereby causing secondary damage, for example, contamination of the encoder or damage to the mechanism.

To prevent such secondary damage, it may be desirable to release a jam without any manual operation by the user.

In this regard, there is a technique to determine the type of jam. When the jam is determined to be a specific type, a driver installed on a computer may automatically send a command to release the jam so that conveyance of the recording medium is automatically stopped and the jammed paper is automatically removed.

However, a jam may occur for various reasons. In addition, automatic discharge of the recording medium may not be possible depending on the status of the recording medium at a time of the jam and the user may need to manually remove the jammed paper. Example embodiments are directed to an image forming apparatus capable of securely releasing a jam.

SUMMARY

Described herein is an image forming apparatus that includes an image processing control unit to process image information sent from an external device, a carriage to move in a main scanning direction according to a control signal sent from the image processing control unit and having a nozzle to discharge an ink onto a recording medium, a conveyance unit to convey the recording medium in a sub-scanning direction, and a conveyance failure detection unit to detect a status of the recording medium conveyed by the conveyance unit. The image processing control unit identifies a type of a conveyance failure among a plurality of types of conveyance failures based on the status of the recording medium output from the conveyance failure detection unit and sends a conveyance failure correction signal to perform an operation for retracting the carriage to a predetermined or desired position in the main scanning direction according to the conveyance failure correction signal to correct the conveyance failure.

Further described herein is an image forming method that includes identifying a type of a conveyance failure among a plurality of types of conveyance failures based on a status of a recording medium output from a conveyance failure detection unit, sending information of the conveyance failure including the type of the conveyance failure to an image processing control unit, sending a conveyance failure correction signal to correct the conveyance failure according to the type thereof from the image processing control unit, and retracting a carriage to a predetermined or desired position in a main scanning direction according to the conveyance failure correction signal.

Further described herein is a control program that includes sending to an image processing control unit information including a status of a recording medium and a type of a conveyance failure identified among a plurality of types of conveyance failures output from a conveyance failure detection unit at a time of the conveyance failure, sending a conveyance failure correction signal to correct the conveyance failure according to the type thereof from the image processing control unit, and retracting a carriage to a predetermined or desired position in a main scanning direction according to the conveyance failure correction signal.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
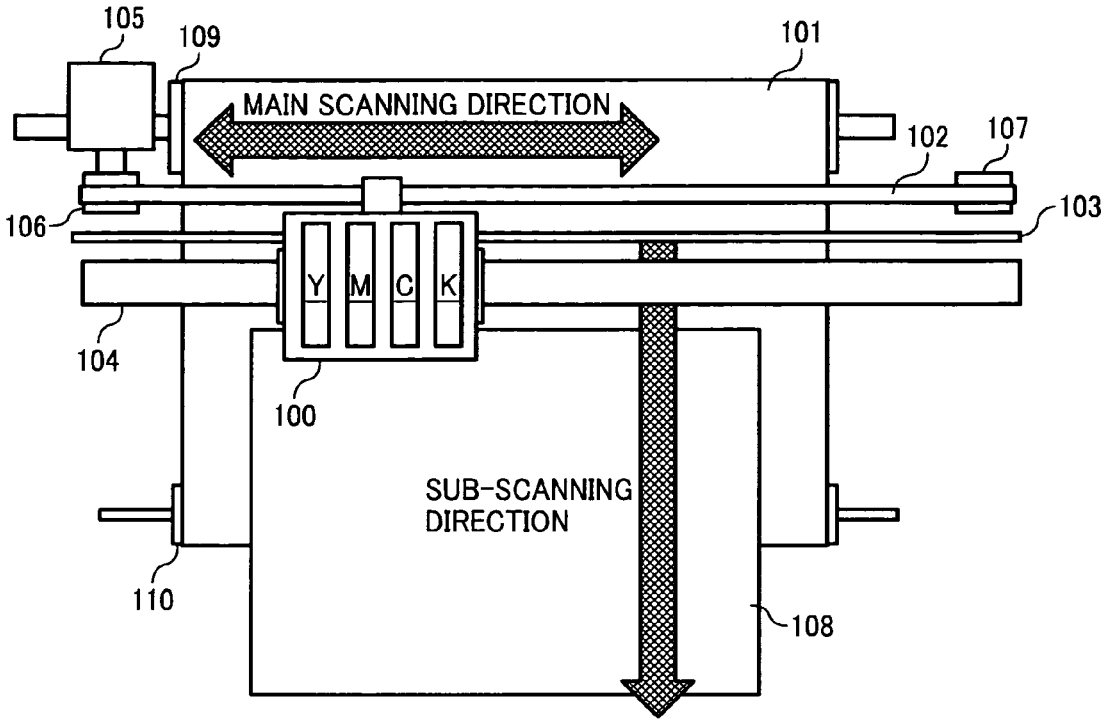
FIG. 1 is a schematic top view illustrating an example inkjet recording apparatus.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Figure 8A:
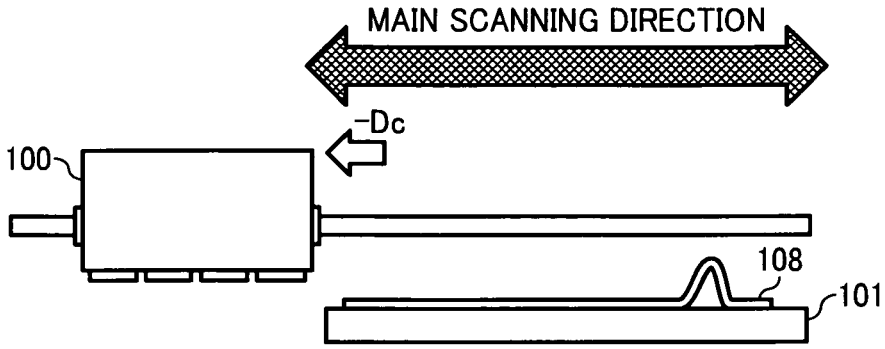
FIG. 8A is an example schematic front view illustrating the main part of the inkjet recording apparatus while retracting the carriage.
Figure 8B:
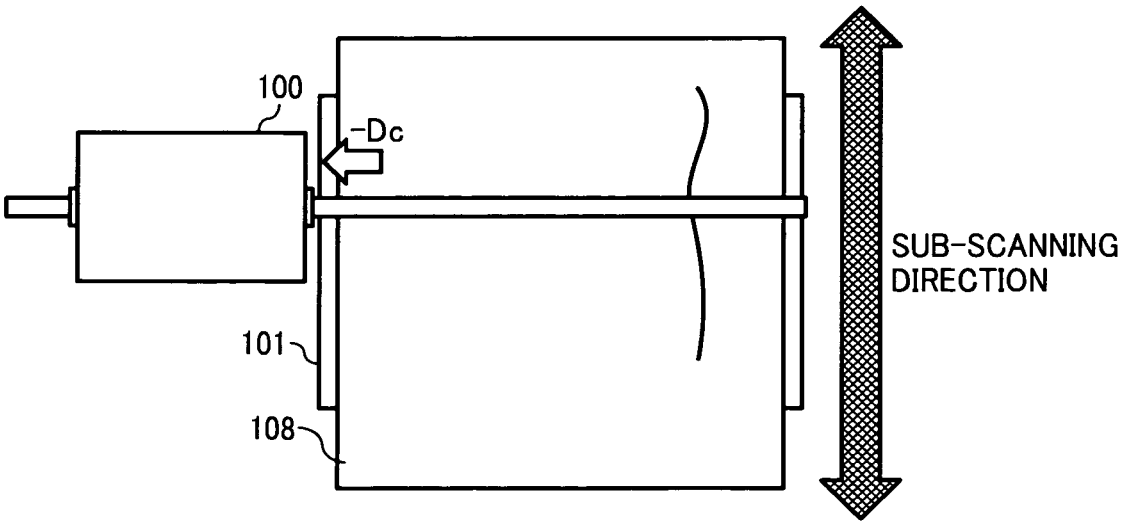
FIG. 8B is an example schematic top view illustrating the main part of the inkjet recording apparatus while retracting the carriage.

Referring now to the drawings, wherein like reference numerals and reference characters designate identical or corresponding parts throughout the several views thereof, particularly to FIGS. 8A and 8B, an image forming apparatus, an image forming method, and a control program therefor according to example embodiments are described.

Figure 2:
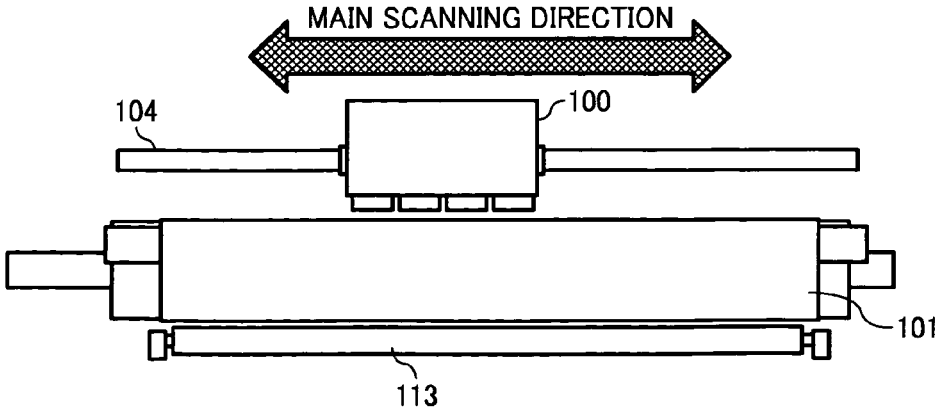
FIG. 2 is an example schematic front view illustrating the inkjet recording apparatus.

FIG. 1 is a schematic top view illustrating an inkjet recording apparatus as an example of an image forming apparatus according to example embodiments. FIG. 2 is an example schematic front view of the inkjet recording apparatus.

The inkjet recording apparatus illustrated in FIG. 1 includes an image processing control unit that processes image information sent from an external device (for example, a computer for downloading images), and has a function to form an image based on a signal sent from the image processing control unit.

For example, the inkjet recording apparatus forms an image according to a signal sent from the image processing control unit by simultaneously moving a carriage 100, which includes nozzles to discharge ink droplets, in a main scanning direction and conveying a recording medium 108 in a sub-scanning direction.

The carriage 100 is held by a guide rod 104 arranged laterally across right and left side plates, not shown, and moved in the main scanning direction by a main scanning motor 105 using a timing belt 102 arranged between a drive pulley 106 and a driven pulley 107.

The carriage 100 may include a recording head having four liquid discharge heads that discharge ink droplets of, for example, yellow (Y), magenta (M), cyan (C), and black (K), respectively. An array of a plurality of ink discharge openings (nozzles) is arranged in a direction perpendicular to the main scanning direction (e.g., in the sub-scanning direction).

It should be noted that although the carriage 100 includes the independent liquid discharge heads in this example, the carriage 100 may include one or a plurality of heads having a plurality of nozzle arrays discharging droplets of a recording liquid of each color. In addition, a number of colors and arrangement thereof are not particularly limited.

A known inkjet head is applicable. For example, a piezoelectric actuator, for example, a piezoelectric element, a thermal actuator using phase change caused by film boiling of liquid by using an electrothermal conversion element, for example, a heat element, a shape-memory alloy actuator using metallic phase change caused by thermal change, or an electrostatic actuator using an electrostatic force may be included in the inkjet head as a pressure generation unit to generate a pressure to discharge the liquid droplets.

The carriage 100 is provided with an encoder scale 103 disposed in the main scanning direction. The encoder scale 103 includes slits formed therein.

The carriage 100 is also provided with an encoder sensor, not shown, that detects the slits of the encoder scale 103. The encoder scale 103 and the encoder sensor are included in a linear encoder to detect the position of the carriage 100 in the main scanning direction.

The inkjet recording apparatus has a function to convey the recording medium 108 on which an image is formed. For example, the recording medium 108 is conveyed facing the recording head by using electrostatic attraction.

An endless belt is used as a conveyance belt 101 to convey the recording medium 108. The conveyance belt 101 is stretched around a conveyance roller 109 and a tension roller 110 and rotated by a sub-scanning motor, not shown, in a belt conveyance direction (e.g., in the sub-scanning direction illustrated in FIG. 1). The conveyance belt 110 is charged by a charging roller 113 (e.g., the conveyance belt 110 receives electrical charges from the charging roller 113) during rotation.

The conveyance belt 101 has either a single layer structure or a multiple layer structure (including two or more layers).

With a single layer structure, the layer is entirely formed of an electrical insulating material since the conveyance belt 101 contacts the recording medium 108 and the charging roller 113.

With a multiple layer structure, the layer contacting the recording medium 108 and the charging roller 113 may be formed of an electrical insulating material and the layer that does not contact the recording medium 108 and the charging roller 113 may be formed of an electrical conductive material.

Figure 3:
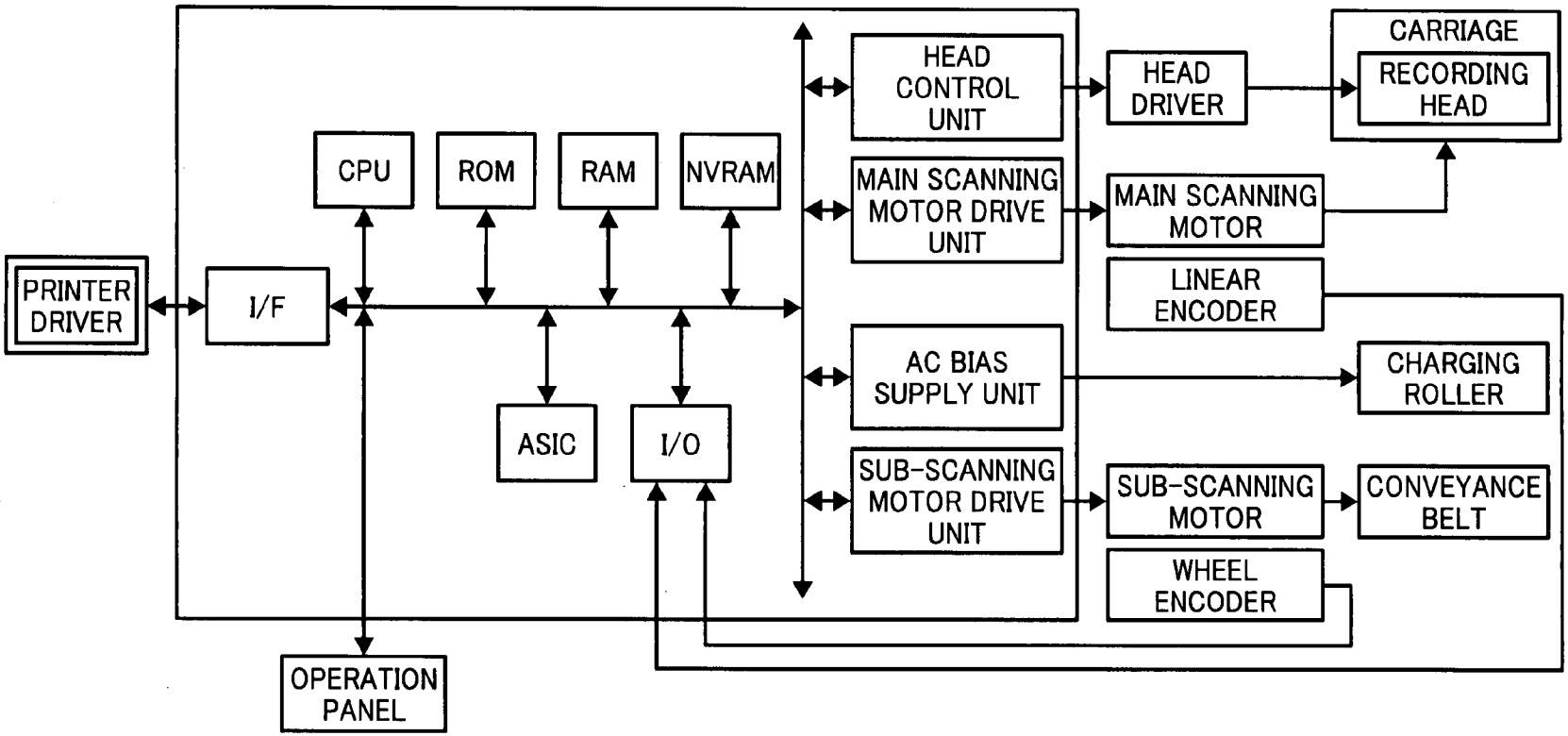
FIG. 3 is an example block diagram illustrating an image processing control unit of the inkjet recording apparatus.

The image processing control unit that controls image formation in the above-described inkjet recording apparatus is now described with reference to an example block diagram illustrated in FIG. 3.

The image processing control unit drives the inkjet recording apparatus by generating a control signal according to image information input from an external source.

For example, the image processing control unit includes a CPU that is involved in conveyance of the recording medium and movement of the recording head, a ROM that stores a program executed by the CPU and other fixed data, a RAM that temporarily stores image information, a rewritable nonvolatile memory (NVRAM) that holds data when the inkjet recording apparatus is powered off, and an ASIC that performs various signal processing operations relating to image information, image processing such as moving data, and processing of input and output signals to control the inkjet recording apparatus.

The image processing control unit also includes an I/F (interface) that sends or receives data signals to or from a host device, a head control unit that generates a drive waveform to drive the recording head and outputs image data and various corresponding data to a head driver to selectively drive the pressure generation unit of the recording head, a main scanning motor drive unit that drives the main scanning motor 105, a sub-scanning motor drive unit that drives the sub-scanning motor, an AC bias supply unit that applies an AC bias to the charging roller, an I/O (input/output) that receives detection pulses from the linear encoder and a wheel encoder and detection signals from various sensors.

An operation panel is connected to the image processing control unit. The operation panel has a display function that allows the user to input information necessary for the image forming apparatus and helps the user with operation.

In the image processing control unit, image data obtained by a printer driver of the host device are received at the I/F via a cable or a network. The host device is, for example, an information processing device, for example, a personal computer, an image reading device, for example, an image scanner, or an imaging device, for example, a digital camera.

The CPU reads image data for printing in a receive buffer included in the I/F and analyzes the image data to process and move the image data in the ASIC. Then, the data is transmitted to the head control unit, which timely outputs the image data and a drive waveform to the head driver.

To output an image, dot pattern data are generated by, for example, storing font data in the ROM or by expanding the image data into bitmap data using the printer driver of the host device and transmitting the bitmap data to the image forming apparatus.

In example embodiments, the dot pattern data are generated using the printer driver.

A drive waveform generation unit included in the head control unit includes a D/A (digital to analog) converter that converts digital pattern data of a drive pulse, which are stored in the ROM and read by the CPU, to analog pattern data and an amplifier. A drive waveform including one or a plurality of drive pulses is output to the head driver.

The head driver drives the recording head by selectively applying the drive pulse of the drive waveform provided by the drive waveform generation unit to the pressure generation unit of the recording head based on image data (dot pattern data), which is serially input to the head driver and corresponds to one line of the recording head.

The head driver includes, for example, a shift register that receives a clock signal and serial image data, a latch circuit that latches the register value of the shift register using a latch signal, a level conversion circuit (level shifter) that changes a level of the output of the latch circuit, and an analog switch array (switch unit). Switching on and off of the analog switch array is controlled by the level shifter so that the drive pulse of the drive waveform is selectively applied to the pressure generation unit of the recording head.

Example movement in the main scanning direction and example movement in the sub-scanning direction in the inkjet recording apparatus are now described with reference to FIGS. 4A, 4B, and 4C.

Figure 4A:
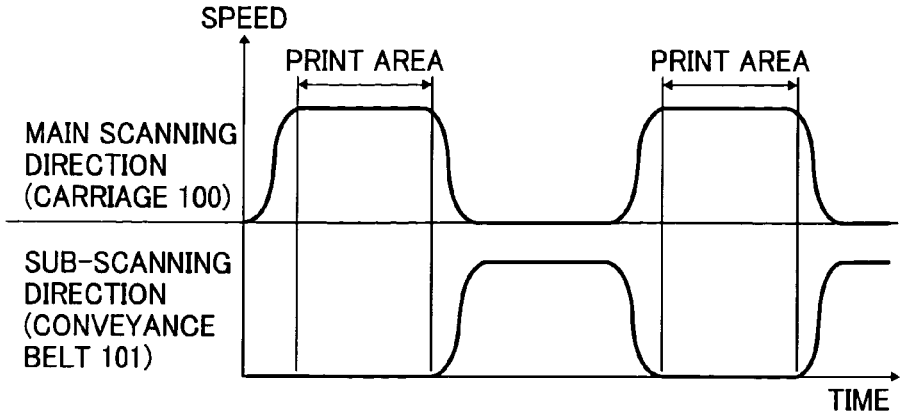
FIG. 4A is an example schematic diagram illustrating movement sequences in a main scanning direction and in a sub-scanning direction, respectively.
Figure 4B:
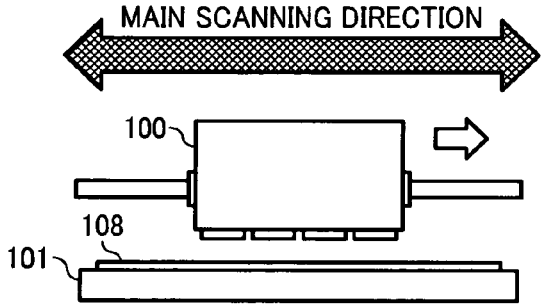
FIG. 4B is an example schematic front view illustrating movement of a carriage in the main scanning direction.
Figure 4C:
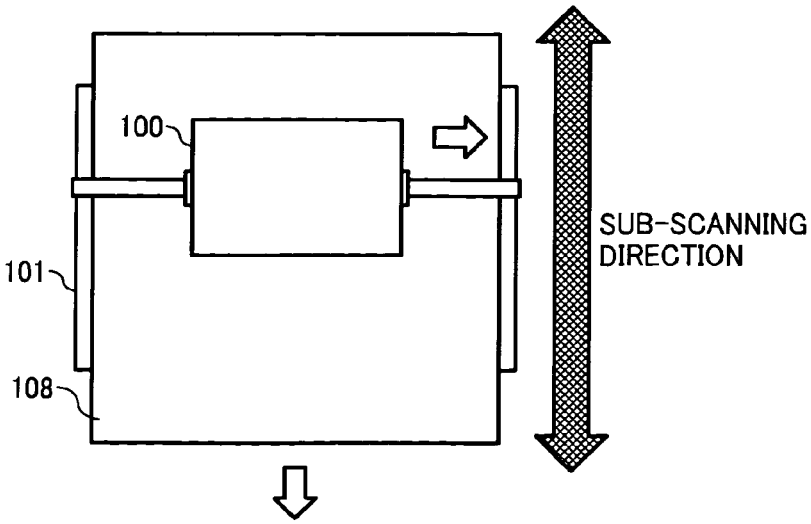
FIG. 4C is an example schematic top view illustrating movement of a recording medium in the sub-scanning direction.

FIG. 4A is an example schematic diagram illustrating movement sequences in the main scanning direction and in the sub-scanning direction, respectively. FIG. 4B is an example schematic front view illustrating movement of the carriage 100 in the main scanning direction. FIG. 4C is an example schematic top view illustrating movement of the recording medium 108 in the sub-scanning direction.

Printing is performed in the print area illustrated in FIG. 4A by moving the carriage 100 in the main scanning direction from left to right (or from right to left) while the conveyance belt 101 is stopped. When the printing in the print area is completed, the carriage 100 starts to reduce speed and the conveyance belt 101 conveys the recording medium 108. When the conveyance is completed, the carriage 100 moves in the main scanning direction from right to left (or from left to right) and printing is performed in the print area.

An image is formed by repeating the above-described printing and conveyance.

An example occurrence of a conveyance failure (hereinafter also referred to as a jam) of the recording medium is now described with reference to FIGS. 5A and 5B.

Figure 5A:
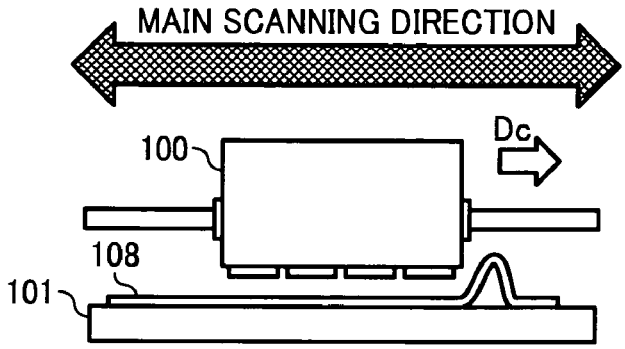
FIG. 5A is an example schematic front view illustrating a main part of the inkjet recording apparatus.

FIG. 5A is an example schematic front view illustrating a main part of the inkjet recording apparatus. FIG. 5B is an example schematic top view illustrating the main part of the inkjet recording apparatus.

Figure 5B:
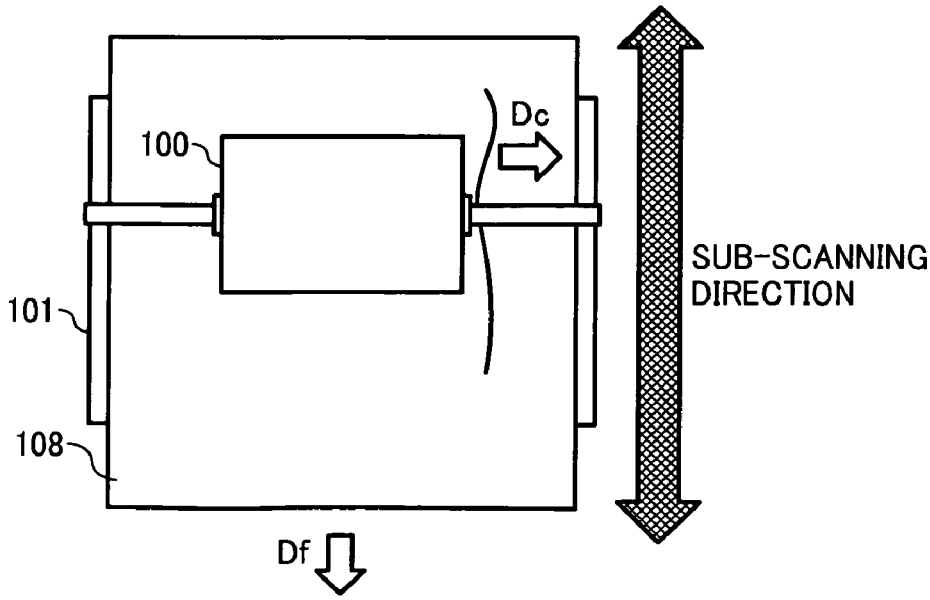
FIG. 5B is an example schematic top view illustrating the main part of the inkjet recording apparatus.

When a problem occurs while conveying the recording medium 108 in a direction indicated by arrow Df shown in FIG. 5B or while scanning the carriage 100 in a direction indicated by arrow Dc shown in FIGS. 5A and 5B, the recording medium 108 is, for example, crumpled and the carriage 100 contacts the recording medium 108, thereby causing a jam.

An example relationship between a carriage speed and a motor output during scanning of the carriage is now described with reference to FIGS. 6 and 7.

Figure 6:
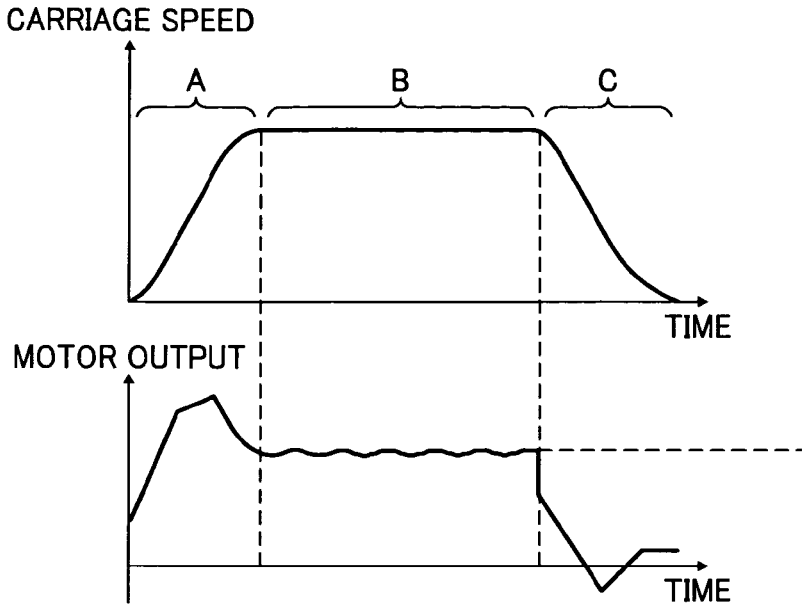
FIG. 6 illustrates an example relationship between a carriage speed and a motor output during a normal operation (when there is no jam)

FIG. 6 illustrates the relationship between a carriage speed and a motor output during a normal operation (e.g., when there is no jam occurring).

During image formation, the carriage 100 is set to increase speed to a targeted level (indicated by A shown in FIG. 6), move at a constant speed after reaching the target speed (indicated by B shown in FIG. 6), and reduce speed to stop (indicated by C in FIG. 6).

While moving the carriage 100 at the constant speed, output of the main scanning motor 105 is substantially constant since the load applied thereto is not greatly changed by the position of the carriage 100.

Figure 7:
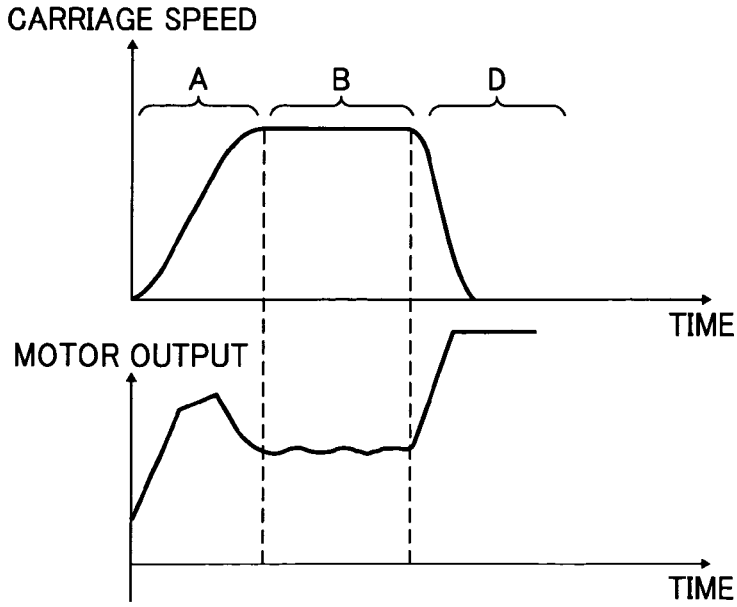
FIG. 7 illustrates an example relationship between the carriage speed and the motor output at a time of a jam.

However, as illustrated in FIG. 7, when the carriage 100 contacts the recording medium 108 and a conveyance failure (jam) occurs while moving the carriage 100 at the constant speed, the speed of the carriage 100 is reduced due to the contact and the output of the main scanning motor 105 is increased (indicated by D shown in FIG. 7). A jam detection unit detects such a change in the motor output and sends a signal to release the jam.

When the occurrence of the conveyance failure (jam) is detected, a type of the jam is identified among a plurality of types of jams based on the status of the recording medium.

When the image processing control unit receives the information of the jam including the type thereof, the image processing control unit sends a jam release signal to release the jam according to the type thereof.

In example embodiments, the carriage 100 is driven to be retracted to a position in the main scanning direction according to the jam release signal.

FIGS. 8A and 8B are example schematic diagrams illustrating retraction of the carriage 100. FIG. 8A is an example schematic front view and FIG. 8B is an example schematic top view.

When the occurrence of the jam is detected, the carriage 100 is retracted according to the jam release signal in a direction indicated by arrow –Dc shown in FIGS. 8A and 8B, which is the direction opposite to the direction (indicated by arrow Dc shown in FIG. 5A and 5B) of movement of the carriage 100 at a time of the jam.

However, the carriage 100 may not be smoothly moved in –Dc direction depending on the status of the jam.

For such a case, in example embodiments, the jam release signal is set to repeat the operation for retracting the carriage 100 for a predetermined or desired number of times.

As illustrated in FIGS. 8A and 8B, the carriage 100 is retracted to a position, for example, to an end of the guide rod 104, not covering the recording medium 108, which allows easy removal of the jammed recording medium 108.

In example embodiments, the jammed recording medium 108 is removed by conveying the recording medium 108 using the conveyance belt 101.

Also, in example embodiments, the jam release signal is set to change the direction of retracting the carriage 100 to the opposite direction, e.g., to Dc direction when the carriage 100 is unable to be retracted to a position allowing removal of the recording medium 108.

In this case, the carriage 100 is moved in the opposite direction (Dc) to a position, for example, to an end of the guide rod 104, not covering the recording medium 108, which similarly allows removal of the recording medium 108.

In example embodiments, the image forming apparatus includes a display unit that displays information of an occurrence of a jam to the user after the operation for retracting the carriage is completed by using the above-described jam release signal. According to the displayed information, the user removes the jammed recording medium.

In example embodiments, the jam release signal includes an instruction to discharge the recording medium using the conveyance belt after the operation for retracting the carriage is performed. The recording medium is automatically discharged without any manual operation by the user, thereby reducing the operational burden.

In this case, in example embodiments, a speed of discharging the recording medium is set at a speed lower than the speed of conveying the recording medium during a normal printing operation.

In example embodiments, charging of the conveyance belt that conveys the recording medium is turned off during the discharging operation.

Consequently, the recording medium 108 is more easily removed and damage to the components caused by the user forcibly moving the carriage 100 is reduced or prevented.

Figure 9:
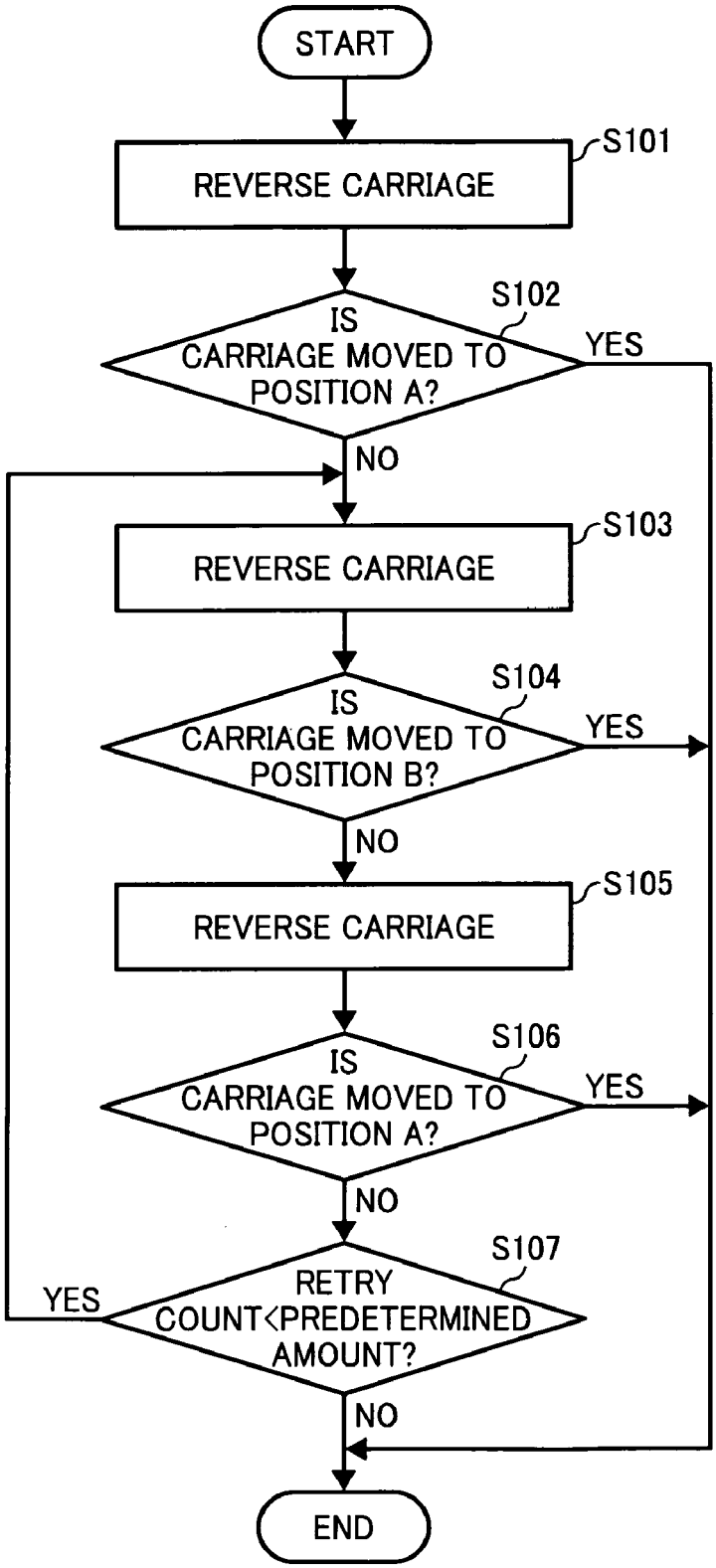
FIG. 9 is an example flowchart illustrating an operation for retracting the carriage.

The operation for retracting the carriage 100 from over the recording medium 108 is now described with reference to an example flowchart illustrated in FIG. 9.

As described above, when a jam occurs, the carriage 100 may contact the recording medium 108 and be unable to be retracted. For such a case, the jam release signal is set to retry the operation for retracting the carriage 100.

For example, when an occurrence of a jam is detected, the carriage 100 is moved in –Dc direction according to the jam release signal (S101) and whether or not the carriage 100 is moved to a predetermined or desired position A is determined (S102). The position A is a position at which the carriage 100 does not cover the recording medium 108. For example, a position for capping the head or a position of an end of the guide rod 104 is used as the position A. The same applies to a position B described below.

When the movement of the carriage 100 to the position A is determined, the operation for retracting the carriage 100 ends. When the carriage 100 is not moved to the position A, the operation is retried for a predetermined or desired number of times. In this retrial, the carriage 100 is repeatedly moved in –Dc direction, or is moved in Dc direction and thereafter vigorously moved in –Dc direction.

For example, when the carriage 100 is moved in –Dc direction and not moved to the position A (S102), the carriage 100 is reversed and moved in Dc direction (S103), and whether or not the carriage 100 is moved to the position B is determined (S104). The position B is a position opposing the position A and at which the carriage 100 does not cover the recording medium 108, for example, a position of another end of the guide rod 104 supporting the carriage 100. When the carriage 100 is not moved to the position B, the carriage 100 is reversed and moved in –Dc direction (S105) and whether or not the carriage 100 is moved to the position A is determined (S106).

The above-described operation is repeated until the carriage 100 is moved to the position A or the position B for up to the predetermined or desired number of times (S107).

The reason for determining the movement of the carriage 100 in Dc direction to the position B at S104 is that, when the carriage 100 is in relatively slight contact with the recording medium 108, the carriage 100 is often moved to the position B, thereby allowing removal of the jammed recording medium.

When S103 and S105 are paired such that the carriage 100 is moved in Dc direction and thereafter moved vigorously in the opposite direction, the determination at S104 may be omitted.

After the above-described operation for retracting the carriage 100 including the retrial is completed, the user is informed of the occurrence of the jam by using the display unit. Therefore, a false operation by the user is prevented before the operation for retracting the carriage 100 is completed.

A jam occurring due to the size of a recording medium is now described.

Figure 10:
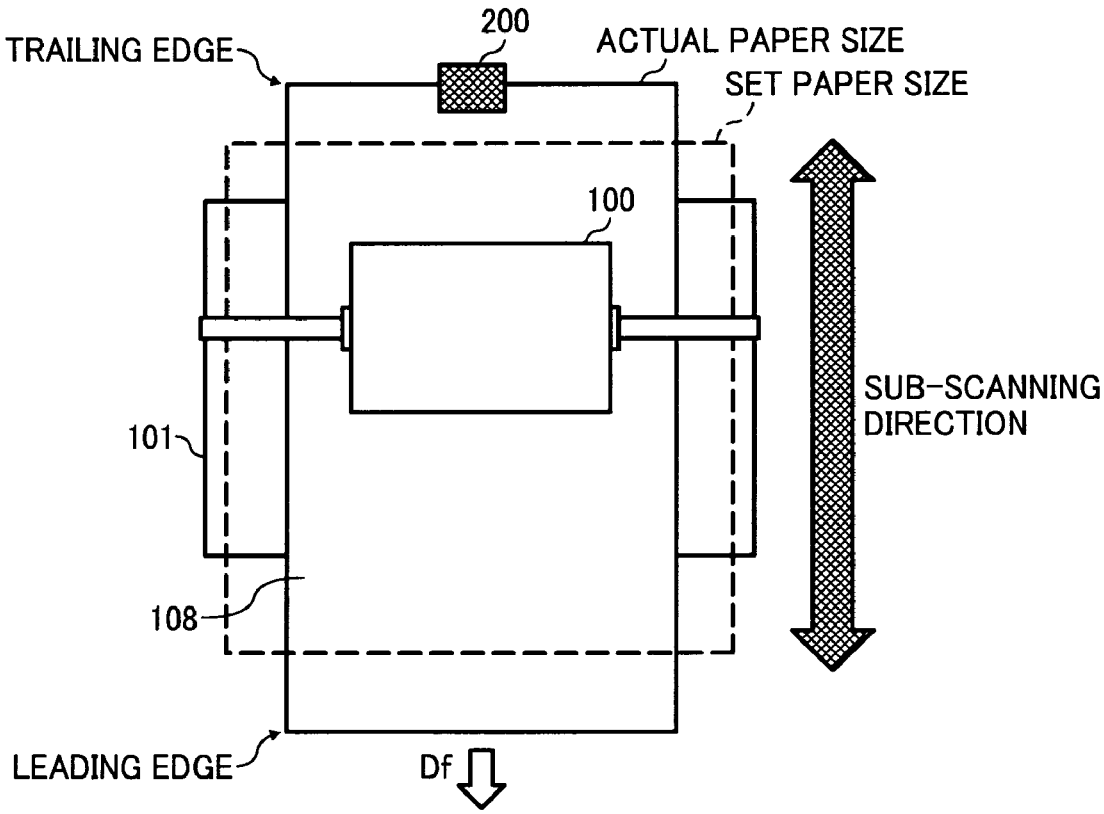
FIG. 10 is an example schematic top view illustrating the main part of the inkjet recording apparatus at a time of a jam occurring while conveying paper.

FIG. 10 is an example schematic top view illustrating the main part of the inkjet recording apparatus when a jam of the present example occurs while conveying the recording medium.

As illustrated in FIG. 10, while conveying the recording medium (recording paper) 108 in the direction indicated by arrow Df shown in FIG. 10 using the conveyance belt 101, the size of the recording paper 108 is calculated by measuring a conveyance amount using the leading edge and the trailing edge of the recording paper 108 passing a sensor 200.

However, when an actual paper size is different from a set paper size, the jam detection unit detects a jam.

Also, a jam is detected when the recording paper 108 is detected from the information of the sensor 200 obtained upon powering on the image forming apparatus.

Such jams are different from a mechanical jam in which the paper is crumpled due to a conveyance failure such as in the above-described example. When a jam is detected simply due to a difference in the paper size, the recording paper 108 is very unlikely to be crumpled and can be discharged immediately after the jam occurs.

By contrast, when a jam in which the recording paper 108 is stuck as illustrated in FIG. 5 occurs, immediate discharging of the jammed paper may cause an excessive load on the apparatus components. Therefore, the carriage 100 is retracted to prevent such an excessive load.

Also, a jam is detected when the recording paper is not appropriately placed and not fed, which is referred to as a non-feed jam. In this case, a discharging operation is not necessary since paper is not present.

As for the non-feed jam, the jam release signal is set to immediately inform the user of the occurrence of the jam.

For example, there are a plurality of types of detected jams in which the jammed paper is immediately removable or not immediately removable. In example embodiments, the jam release signal is set to automatically and appropriately release the jam according to the type of the jam.

In example embodiments, the charge is removed from the conveyance belt 101 when the jammed paper is discharged.

By removing the charges from the conveyance belt 101, the conveyance belt 101 comes in sliding contact with the recording paper 108, and therefore the load on the mechanism components is reduced or prevented even when the recording paper 108 is removed while contacting the mechanism components.

The jammed paper may be discharged by automatically driving the conveyance belt according to a command preliminarily incorporated in the jam release signal or by a manual operation by the user, for example, a button operation or opening and closing of a cover.

In example embodiments, the operation for discharging the jammed paper by the user to release the jam is limited in advance to a predetermined or desired number of times per occurrence of the jam to prevent an excessive load on the components.

It should be noted that example embodiments may be performed by an image forming system combining the above-described image forming apparatus (inkjet recording apparatus) having a function to form an image on a recording medium with an input device that sends image information to the image forming apparatus.

Figure 11:
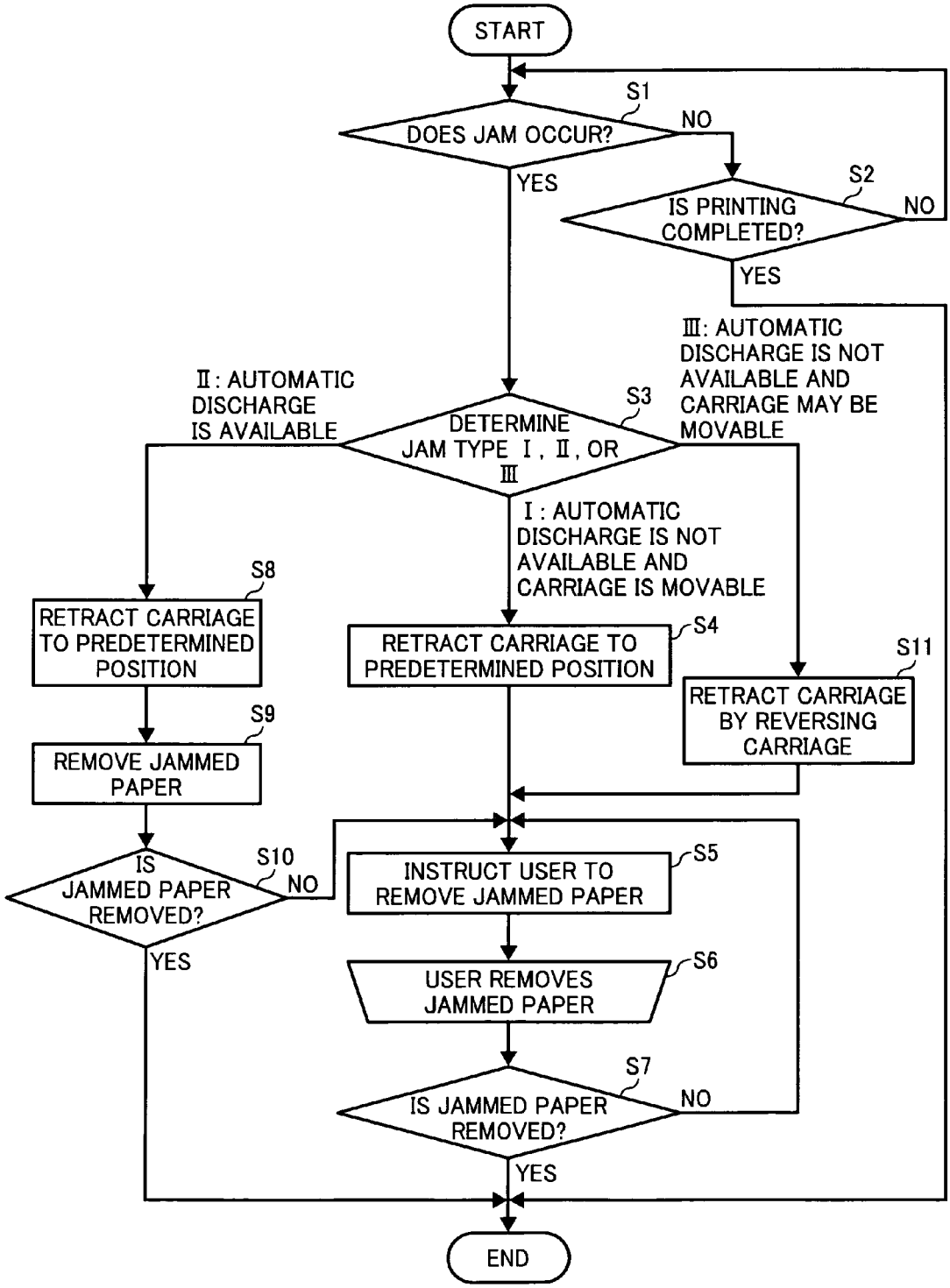
FIG. 11 is a flowchart illustrating an image forming method according to example embodiments.

An image forming method according to example embodiments is now described with reference to a flowchart illustrated in FIG. 11.

The image forming method includes operations of identifying a type of a jam based on the status of the recording medium output from the jam detection unit, sending information of the jam including the type of the jam to the image processing control unit, which is a control mechanism for the image forming apparatus, sending a jam release signal to release the jam according to the type thereof, and retracting the carriage to a predetermined or desired position in the main scanning direction according to the jam release signal.

The image forming method is now described in detail.

When printing is started in the image forming apparatus, the image is formed by alternately moving the carriage in the main scanning direction and the recording medium in the sub-scanning direction.

When a jam does not occur and printing is determined to be completed (S2), processing ends.

When a jam occurs (S1) during printing, the type of the jam is determined (S3).

There are three types of jam: (I) one for which the jammed paper cannot be automatically discharged and the carriage is movable; (II) one for which the jammed paper can be automatically discharged; and (III) one for which the jammed paper cannot be automatically discharged and the carriage may be movable.

The jam of (I) includes a non-feed jam for which there is no need to discharge the jammed paper.

The jam of (II) includes a jam detected when the size of the recording medium is different from the preset size.

The jam of (III) includes a jam occurring when the carriage 100 contacts the recording medium and the recording medium is, for example, crumpled.

The jam type (I), (II), or (III) is determined from information obtained from the sensor disposed in the conveyance path of the recording medium illustrated in FIG. 10 or a change in data of the output of the main scanning motor 105 illustrated in FIG. 7.

To be exact, when a jam detected from the output of the main scanning motor 105 illustrated in FIG. 7 may include a case in which an abnormal signal is input to a PID (proportional-integral-derivative) control processing unit due to, for example, contamination of the encoder scale 103. In such a case, it is possible to automatically discharge the recording medium since a jam does not actually occur. However, setting the image forming apparatus to exactly distinguish an actual jam from such a signal problem is practically unfavorable since the operation is interrupted. Therefore, both cases may be detected as a jam for which the recording medium cannot be automatically discharged and then the jam may be released.

When the jam is determined to be the jam of (I) for which the carriage is movable at S3, the carriage 100 is retracted to a predetermined or desired position (S4) and the user is instructed to remove the jammed paper (S5). After the user removes the jammed paper (S6), whether or not the jammed paper is removed is determined (S7).

The jammed paper is easily removed by conveying the paper by rotating a rotatable dial engaging the conveyance belt 101 via at least one of gears of the conveyance roller 109.

When the jammed paper is not removed, the user is instructed to remove the jammed paper again (S7→S5).

When the jam is determined to be the jam of (II) for which the carriage is movable at S3, the carriage 100 is retracted to a predetermined or desired position (S8), the jammed paper is discharged (S9), and whether or not the jammed paper is removed is determined (S10). When the jammed paper is removed, processing ends. When the jammed paper is not removed, the user is instructed to remove the jammed paper (S10→S5).

The jammed paper may be discharged by automatically driving the conveyance belt according to a command preliminarily incorporated in the jam release signal or by a manual operation by the user, for example, a button operation or opening and closing of a cover.

The processing at S9 and S10 is the same as that described with reference to FIG. 10.

When the jam is determined to be the jam of (III) for which whether or not the carriage is movable is uncertain at S3, the operation for retracting the carriage 100 in the direction opposite to the direction of movement of the carriage 100 at a time of the jam is performed (S11). Then, processing proceeds to S5 (S11→S5).

The processing at S11 is the same as that described with reference to FIGS. 8A, 8B, and 9.

The above-described image forming method according to example embodiments is performed by a control program that sends a drive signal to the image processing control unit of the image forming apparatus.

For example, the control program includes sending to the image processing control unit information including the status of the recording medium and a type of a jam identified among a plurality of types of jams output from the jam detection unit at a time of the jam, sending a jam release signal to release the jam according to the type thereof from the image processing control unit, and retracting the carriage to a predetermined or desired position in the main scanning direction according to the jam release signal.

The control program may be preliminarily installed in the image forming apparatus according to example embodiments. Alternatively, the control program may be stored in an information storage medium, read therefrom, and executed.

A conveyance unit of the recording medium (recording paper) in the image forming apparatus and the image forming system according to example embodiments is now described in detail.

The conveyance unit includes the conveyance belt. The conveyance belt may be an endless belt or the ends thereof may be attached.

To attach the recording paper to the conveyance belt, a static electricity may be provided to the conveyance belt to attract the recording paper. Alternatively, a pressure roller may be provided to press the recording paper against the conveyance belt.

Figure 12:
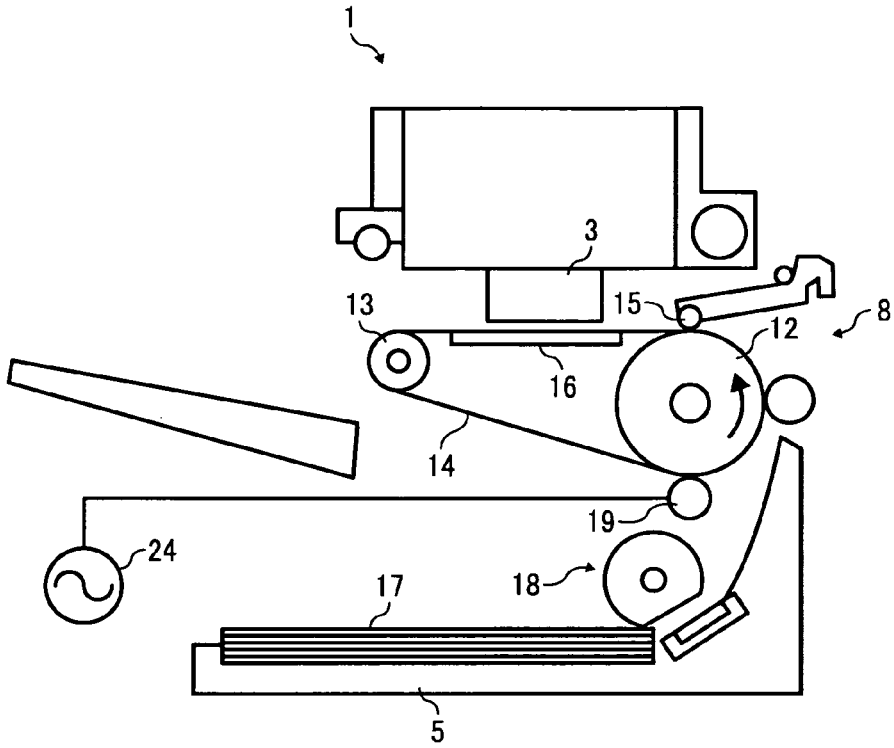
FIG. 12 is a schematic view illustrating an example configuration of a recording medium conveyance unit using electrostatic attraction.

FIG. 12 is a schematic view illustrating an example configuration of a recording medium conveyance unit using electrostatic attraction.

The conveyance unit 8 includes a rotatable conveyance belt 14 stretched around a drive roller 12 and a driven roller 13, a press roller 15 pressed against the drive roller 12 with the conveyance belt 14 therebetween by an elastic force of an elastic member, for example a spring to prevent slippage between the drive roller 12 and the conveyance belt 14, a conveyance guide 16 disposed between the drive roller 12 and the driven roller 13 and facing the recording head 3, and a belt charging roller 19 disposed opposite the drive roller 12. The belt charging roller 19 contacts the conveyance belt 14 at a position on the upstream side relative to the position at which recording paper 17 contacts the conveyance belt 14 in the direction of rotating the drive roller 12. The recording paper 17 is stored in a paper feed tray 5, sent, and separated by a separation unit 18.

The drive roller 12 is connected to earth.

Figure 13A:
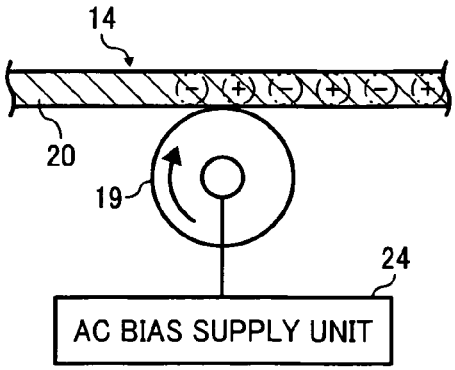
FIGS. 13A and 13B are example schematic cross-sectional views illustrating a conveyance belt.
Figure 13B:
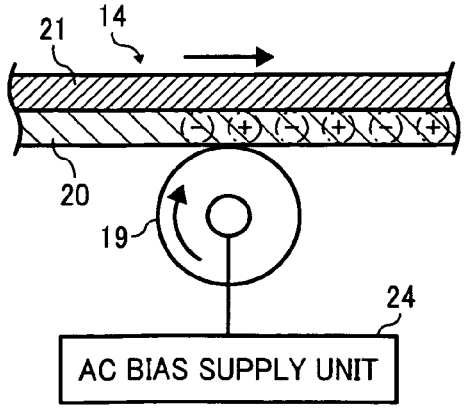

The conveyance belt 14 has either a single layer structure illustrated in FIG. 13A or a two-layer structure illustrated in FIG. 13B.

The layer contacting the recording paper 17 and the belt charging roller 19 is an electrical insulating layer 20. With the two-layer structure illustrated in FIG. 13B, the layer that does not contact the recording paper 17 and the belt charging roller 19 is an electrical conductive layer 21.

The electrical insulating layer 20 is formed of resin or elastomer, for example, PET (polyethylene terephthalate), PEI (polyetherimide), PVDF (polyvinylidene-fluoride), PC (polycarbonate), ETFE (ethylene tetrafluoroethylene), or PTFE (polytetrafluoroethylene) that does not contain a conductivity control material. The electrical insulating layer 20 has a volume resistivity of $10^{12}$ Ωcm or more, for example, $10^{15}$ Ωcm or more.

The electrical conductive layer 21 is formed of the above-described resin or elastomer containing carbon and has a volume resistivity of $10^5$ to $10^7$ Ωcm.

Figure 14A:
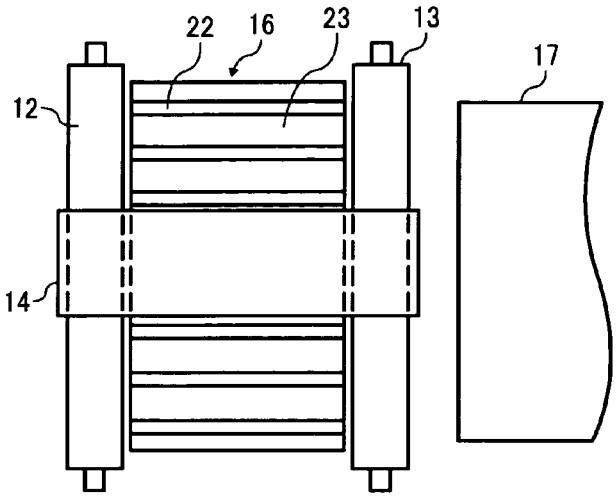
FIG. 14A is an example top view illustrating the conveyance belt.
Figure 14B:
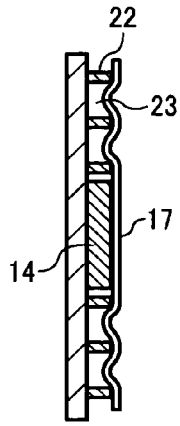
FIG. 14B is an example sectional side view illustrating the conveyance belt.

FIG. 14A is an example top view illustrating the conveyance belt 14 and FIG. 14B is an example sectional side view illustrating the conveyance belt 14. As illustrated in FIG. 14A, the conveyance belt 14 has a width less than the width of the recording paper 17 and is stretched around the substantial center of the drive roller 12 and the substantial center of the driven roller 13.

The conveyance guide 16 is disposed in the width direction of the conveyance belt 14. The conveyance guide 16 includes a plurality of ribs 22 and a plurality of grooves 23 that are alternately disposed along the conveyance direction of the recording paper 17.

The belt charging roller 19 is connected to an AC bias supply unit 24 that supplies an AC bias of, for example, 2 to 3 kV as illustrated in FIGS. 13A and 13B.

When the above-described serial type inkjet printer receives a command to output an image, the conveyance belt 14 is rotated counterclockwise by rotating the drive roller 12 of the conveyance unit 8 using a drive motor, not shown. At the same time, an AC bias is applied to the belt charging roller 19 from the AC bias supply unit 24.

By applying the AC bias to the belt charging roller 19, positive and negative charges alternate in the electrical insulating layer 20 of the conveyance belt 14 in the direction of movement of the conveyance belt 14 as illustrated in FIGS. 13A and 13B.

Since the electrical insulating layer 20 with positive and negative charges is formed to have a volume resistivity of $10^{12}$ Ωcm or more, for example, $10^{15}$ Ωcm or more, the positive and negative charges in the electrical insulating layer 20 are reduced or prevented from moving across a border therebetween, thereby allowing stable provision of alternating positive and negative charges to the electrical insulating layer 20.

Figure 15A:
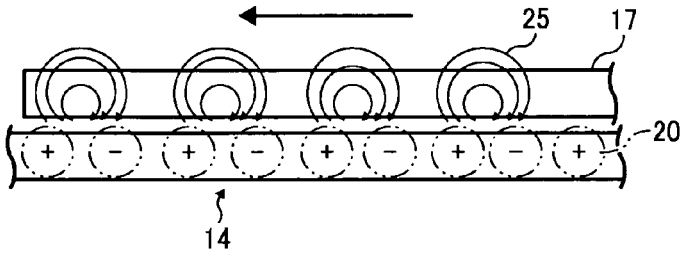
FIGS. 15A and 15B illustrate an example charged conveyance belt.
Figure 15B:
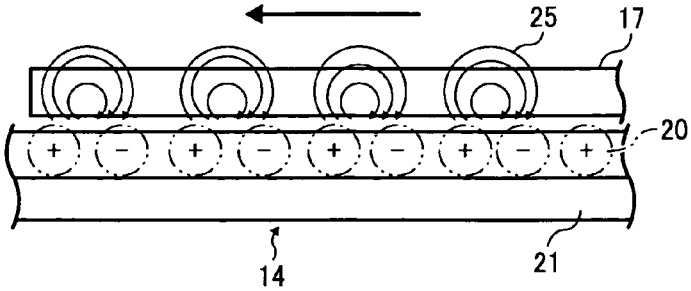

When the recording paper 17 separated by the separation unit 18 is fed and contacts the conveyance belt 14, an electrostatic force generated by a small electric field 25 induced from the positive charge to the negative charge in the electrical insulating layer 20 acts on the recording paper 17 as illustrated in FIGS. 15A and 15B, thereby attracting the center part of the recording paper 17 to the conveyance belt 14.

As described above, the belt charging roller 19 that provides positive and negative charges to the conveyance belt 14 to attract the recording paper 17 to the conveyance belt 14 is disposed near and on the upstream side relative to the position where the recording paper 17 contacts the conveyance belt 14 in the direction of rotating the drive roller 12. Therefore, the positive and negative charges are provided to the conveyance belt 14 by the belt charging roller 19, which ensures generation of the small electric field 25 at the position where the recording paper 17 contacts the conveyance belt 14, thereby allowing stable attraction of the recording paper 17 to the conveyance belt 14.

The recording paper 17 attracted to the conveyance belt 14 is pressed by the press roller 15 according to the rotation of the conveyance belt 14 and conveyed to a printing unit.

When a leading end of an image forming area of the recording paper 17 is placed below the recording head 3, the drive roller 12 stops rotating to stop the conveyance belt 14. In this state in which the recording paper 17 stops, the recording head 3 is moved by a carriage in the main scanning direction, back and forth, pushing out ink droplets to form an image on the recording paper 17.

When the image formation on the leading end of the image forming area of the recording paper 17 is completed, the drive roller 12 is driven again to rotate the conveyance belt 14 and convey the recording paper 17. When a next image forming area of the recording paper 17 is placed below the recording head 3, the drive roller 12 stops rotating to stop the conveyance belt 14 to perform image formation on the recording paper 17.

By repeating the conveying and stopping of the recording paper 17 using the conveyance belt 14, an image is formed on the recording paper 17.

As described above, during image formation performed by repeating the conveying and stopping of the recording paper 17, the recording paper 17 is attracted and fixed to the conveyance belt 14 by the electrostatic force exerted by the small electric field 25. In addition, the recording paper 17 electrostatically attached to the conveyance belt 14 is pressed against and attached to the conveyance belt 14 with a constant force by using the press roller 15, thereby allowing stable conveyance of the recording paper 17 to the recording head 3.

In addition, the conveyance belt 14 is pressed against the drive roller 12 with a constant force to increase a frictional force between the drive roller 12 and the conveyance belt 14, thereby preventing slippage between the drive roller 12 and the conveyance belt 14 and accurately conveying and stopping the recording paper 17.

As illustrated in FIGS. 15A and 15B, the recording paper 17 is attracted to the conveyance belt 14 by the electrostatic force exerted by the small electric field 25 intermittently generated by the alternating positive and negative charges in the conveyance belt 14 at a constant interval of, for example, 4 mm. Therefore, an effect of the electrostatic force on the ink droplets pushed out from the recording head 3 is reduced, and therefore the ink droplets are pushed out to appropriate positions. Consequently, a high-quality image is stably formed on the recording paper 17 without causing image displacement.

While forming an image on the recording paper 17 by pushing out ink droplets from the recording head 3 thereto, the ink droplets penetrate the recording paper 17 and the recording paper 17 is stretched, thereby causing cockling of the recording paper 17.

As illustrated in FIG. 14B, the rib 22 of the conveyance guide 16 maintains the height of the stretched recording paper 17 while the stretched recording paper 17 hangs down between the ribs 22 to the grooves 23. The ink droplets penetrate the recording paper 17 and therefore the recording paper 17 is prevented from floating away. Consequently, displacement of the ink droplets on the recording paper 17 due to cockling is prevented.

Also, the recording paper 17 is prevented from contacting the nozzle surface of the recording head 3, thereby preventing contamination of the nozzle surface of the recording head 3 and the recording paper 17. Consequently, a high-quality image is more stably formed.

After the image formation is performed as described above, the recording paper 17 is conveyed downstream relative to the recording head 3 by the movement of the conveyance belt 14.

When the direction of moving the conveyance belt 14 is changed by the drive roller 12, the recording paper 17 is separated from the conveyance belt 14 by the stiffness of the recording paper 17 and conveyed to a discharge part.

The recording paper 17 is easily separated from the conveyance belt 14 without any complex mechanism for separating the recording paper since the recording paper 17 is attracted to the conveyance belt 14 by the electrostatic force exerted by the small electric field 25 intermittently generated by alternating positive and negative charges generated at a constant pitch in the conveyance belt 14.

Also, since only the intermittently generated small electric field 25 is applied to the recording paper 17, the static electricity is reduced or prevented from remaining on the discharged recording paper 17.

When the conveyance belt 14 has a two-layer structure including the electrical insulating layer 20 and the electrical conductive layer 21, the positive and negative charges in the electrical insulating layer 20 are discharged to a certain level during movement of the conveyance belt 14 from the recording head 3 to the driven roller 13. Therefore, the recording paper 17 is more easily separated from the conveyance belt 14.

In the above description, an AC bias is applied to the belt charging roller 19 even when the conveyance belt 14 is stopped to form an image on the recording paper 17 by pushing out ink droplets and moving the recording head 3 in the main scanning direction, back and forth, by using the carriage. It should be noted that example embodiments are not limited to the above-described examples and the application of the AC bias to the belt charging roller 19 may be stopped when the conveyance belt 14 is stopped.

By stopping the application of the AC bias to the belt charging roller 19 while stopping the conveyance belt 14, the need for removing the charges provided to the portion where the conveyance belt 14 contacts the belt charging roller 19 by using the AC bias is eliminated or a wrong electrical charge is prevented from being applied to the conveyance belt 14. Therefore, the recording paper 17 is stably attracted to the conveyance belt 14 when the conveyance belt 14 resumes rotation.

Also, heat may be generated in the conveyance belt 14 by continuously applying charges to a part of the conveyance belt 14 even with a slight amount of electricity flowing during charging of the conveyance belt 14, which may cause pinholes and lead to leakage. By stopping the application of the AC bias to the belt charging roller 19 while stopping the conveyance belt 14, such a damage to the conveyance belt 14 is prevented.

Also, in the above description, the press roller 15 is formed of an electrical insulating material and the AC bias is applied to the belt charging roller 19 when the inkjet printer 1 receives a command to output an image and the recording paper 17 is fed. It should be noted that example embodiments are not limited to the above-described example. For example, when the inkjet printer 1 receives a command to output an image, an AC bias may be applied to the belt charging roller 19 by continuously rotating the conveyance belt 14 and positive and negative charges are provided to the conveyance belt 14. In this case, the recording paper 17 is fed after the application of an AC bias to the belt charging roller 19 is stopped in a state in which positive and negative charges are already provided to the entire conveyance belt 14. By providing positive and negative charges while continuously rotating the conveyance belt 14, the positive and negative charges are stably provided to the conveyance belt 14.

Figure 16:
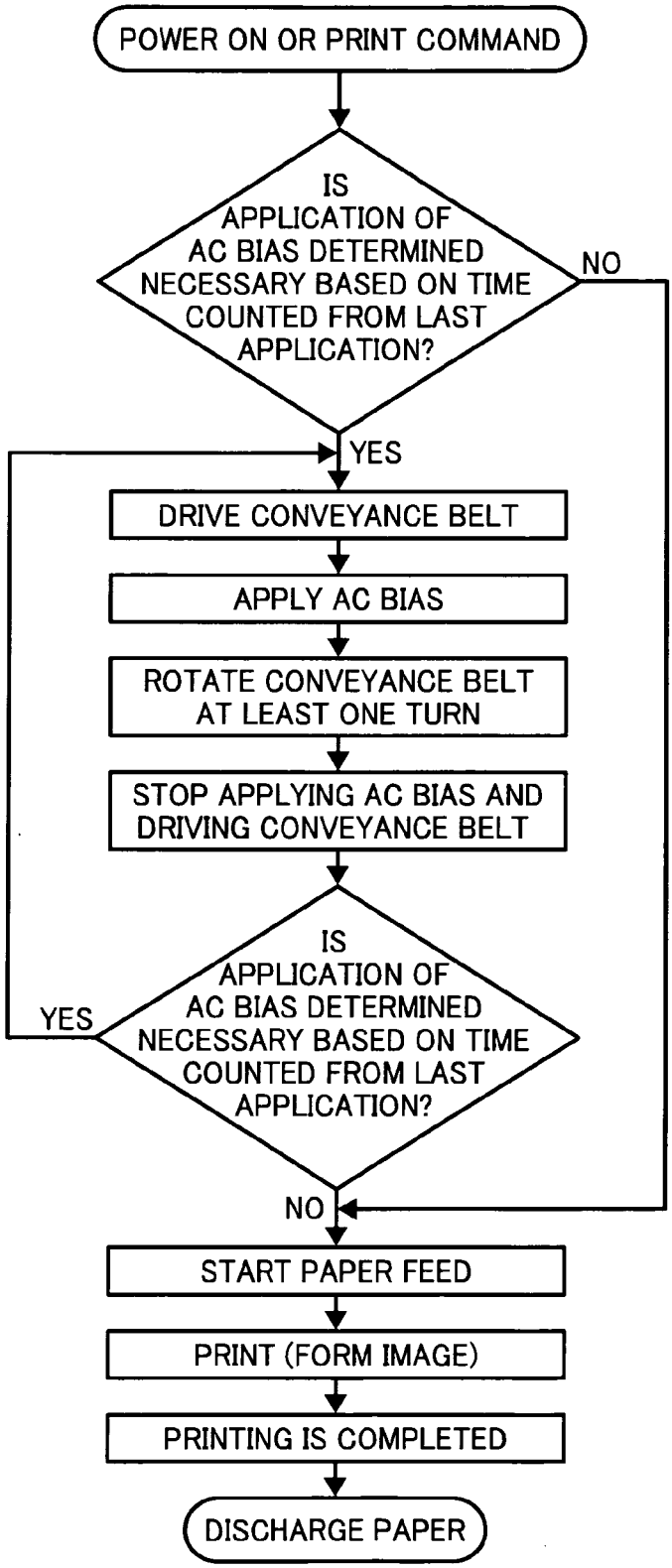
FIG. 16 illustrates an example operational sequence in which recording paper is fed after the conveyance belt is charged by applying an AC bias to a charging roller.

FIG. 16 illustrates an example operational sequence in which recording paper is fed after the conveyance belt is charged by applying an AC bias to the charging roller while continuously rotating the conveyance belt. For example, when the printer is powered on or when the printer receives a print command after the printer is powered on (e.g., in a stand-by mode), the printer counts the time from last application of an AC bias by calculating the time between a current time and a last application time stored in a real-time clock in the printer and determines whether or not to apply an AC bias. While applying an AC bias to the charging roller, the conveyance belt is rotated more than one rotation to sufficiently charge the conveyance belt. After the conveyance belt is entirely charged with an AC bias, the application and driving of the conveyance belt are stopped. Then, the printer determines whether or not to apply an AC bias based on the time counted from the last application since charges are gradually discharged over a period of time.

Figure 17:
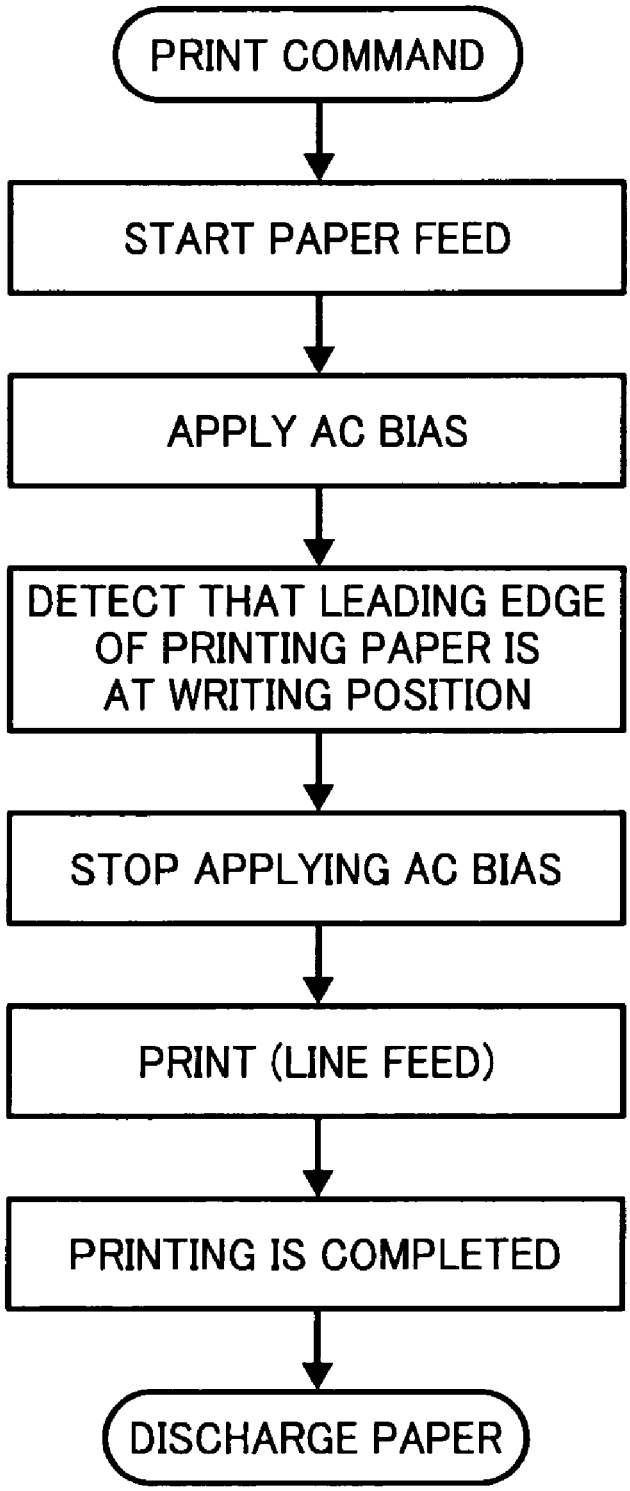
FIG. 17 illustrates an example operational sequence in which the conveyance belt is charged by applying an AC bias to the charging roller until a leading edge of printing paper is moved to a writing position.

FIG. 17 illustrates an example operational sequence in which the conveyance belt is charged by applying an AC bias to the charging roller until a leading edge of printing paper is moved to a writing position. In this case, the AC bias is applied to the charging roller before printing and the application is stopped during printing.

Figure 18:
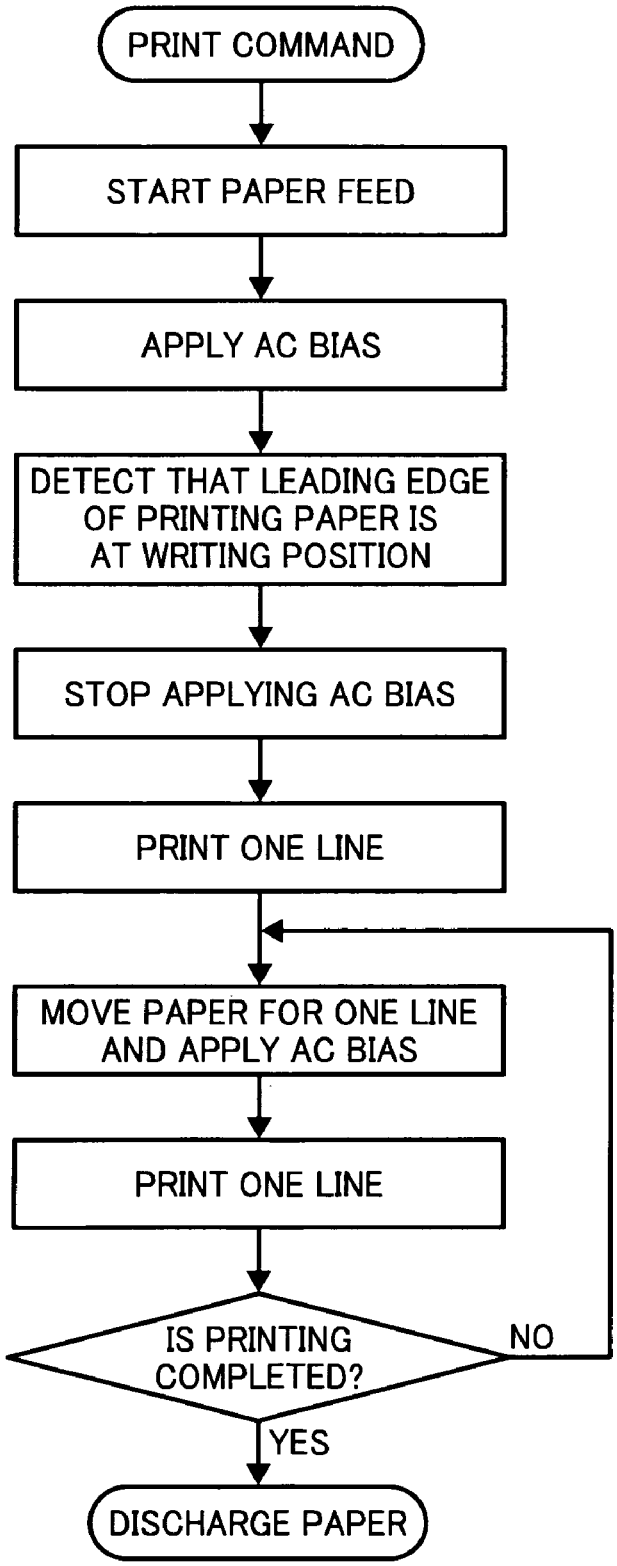
FIG. 18 illustrates an example operational sequence in which application of an AC bias to the charging roller is stopped while printing paper is stopped.

FIG. 18 illustrates an example operational sequence in which application of an AC bias to the charging roller is stopped while recording paper is stopped. Therefore, the AC bias is applied to the charging roller before printing and while conveying the recording paper during printing.

The driving amount of the conveyance belt for one line during image formation (herein after referred to as an amount for one line) is either an integral multiple of a charging pitch or not an integral multiple of the charging pitch. The charging pitch is a length corresponding to a rise (or fall) of an output of a high-voltage power supply applied to the conveyance belt. The value of the output of the high-voltage power supply is indicated by a power pack output illustrated in FIG. 19. The charging pitch is, for example, 8 mm for a sheet of plain paper, glossy paper, or coated paper, a postcard, or an envelop and 4 mm for an OHP (overhead projector) sheet.

Figure 19:
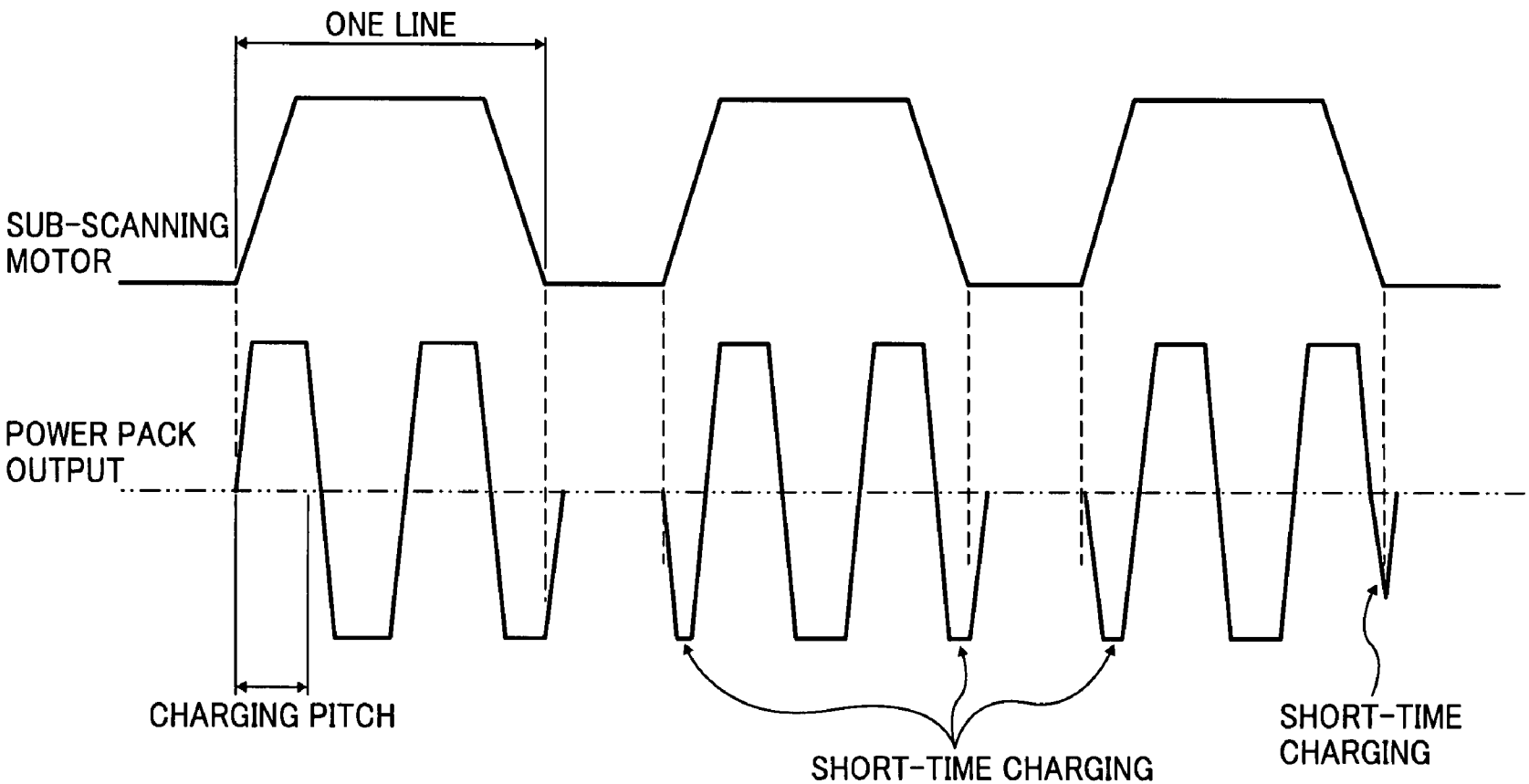
FIG. 19 illustrates an example relationship between a driving amount of the conveyance belt (for one line) and a charging pitch.

As illustrated in FIG. 19, when the amount for one line is not an integral multiple of the charging pitch or more than the charging pitch, the output of the high-voltage power supply is switched between plus and minus while the conveyance belt is driven. In this case, when one line is completed before the conveyance belt is charged for the desirable charging pitch, the rest is charged while the conveyance belt is driven for a subsequent line.

Therefore, a desirable charging pitch is achieved even when the operation for one line is completed before the charging pitch of a predetermined or desired width is formed.

By stably forming the charging pitch, stable attraction of the recording paper is achieved.

Figure 20:
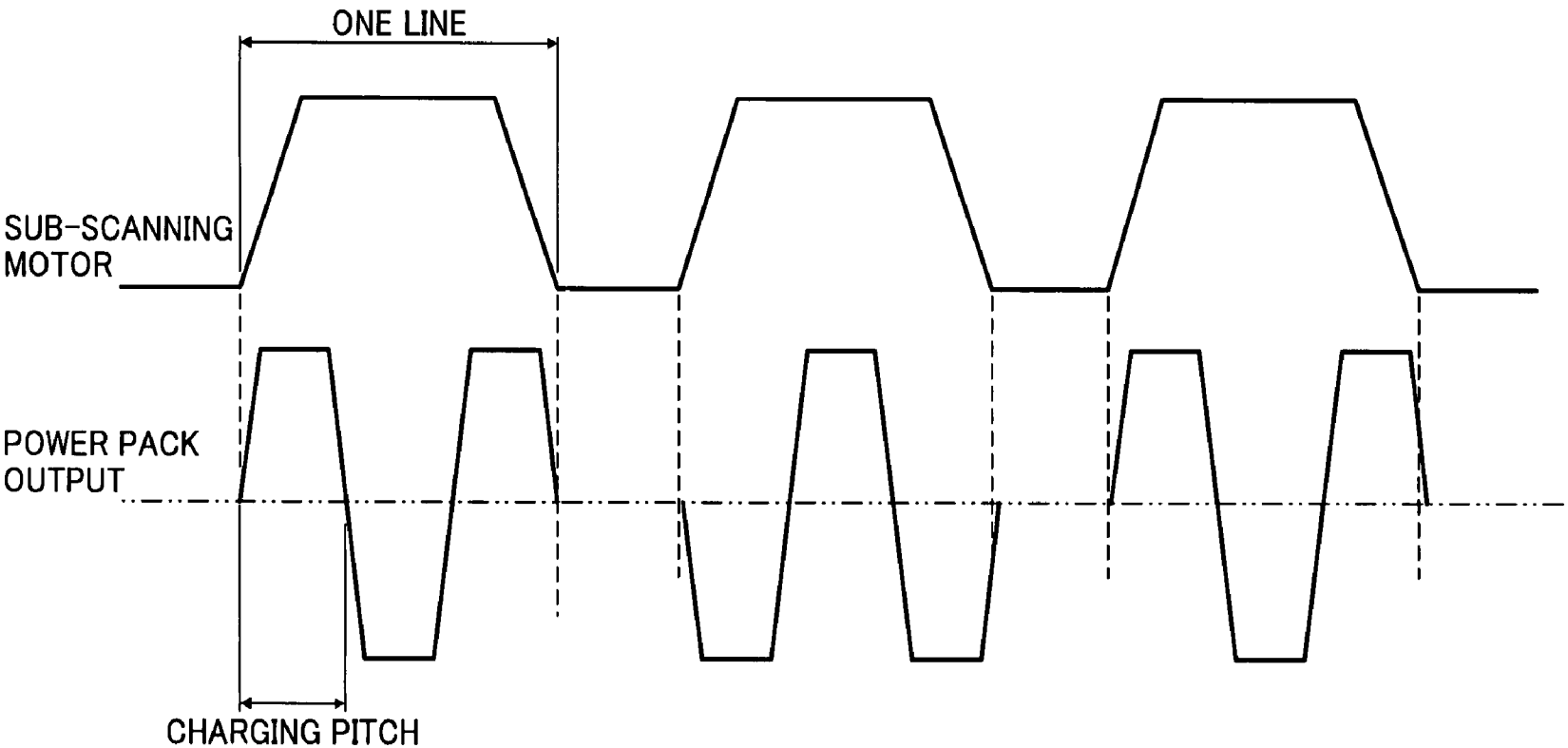
FIG. 20 illustrates an example relationship between the driving amount of the conveyance belt (for one line) and the charging pitch.

FIG. 20 illustrates an example case in which the charging pitch is set such that the amount for one line is an integral multiple of the charging pitch, which may be preferable in comparison with the case in which the amount for one line is not an integral multiple of the charging pitch.

The amount for one line is determined based on a pixel density of an image to be formed and a nozzle pitch and a number of nozzles of the recording head.

In a typical serial type image forming apparatus using inkjet printing, multiple selection of the pixel density is possible. By using 1/n (n is an integer) of the greatest common factor of all the amounts for one line of the image forming apparatus as the charging pitch, formation of the charging pitch is completed while the conveyance belt is driven for one line as illustrated in FIG. 20.

Consequently, charging with a potential lower than a desirable level is reduced or prevented, thereby achieving a stable potential level since short-time charging illustrated in FIG. 19 is not necessary. Such short-time charging does not mean generation of a desirable charging potential on the conveyance belt via the charging roller even when the output of the high-voltage power supply rises to a desirable potential.

As described above, the recording paper 17 is attracted to and conveyed by the conveyance belt 14 to the recording head 3 and the conveyance belt 14 is intermittently and repeatedly stopped and moved in the serial type inkjet printer 1. Therefore, the stop position of the conveyance belt 14 is precisely controlled to achieve a stable accuracy of starting a new line during printing.

In example embodiments, the speed or amount of moving the conveyance belt 14 is detected directly or indirectly to control the conveyance amount of the recording paper 17 according to the detected speed or amount of moving the conveyance belt 14.

Figure 21A:
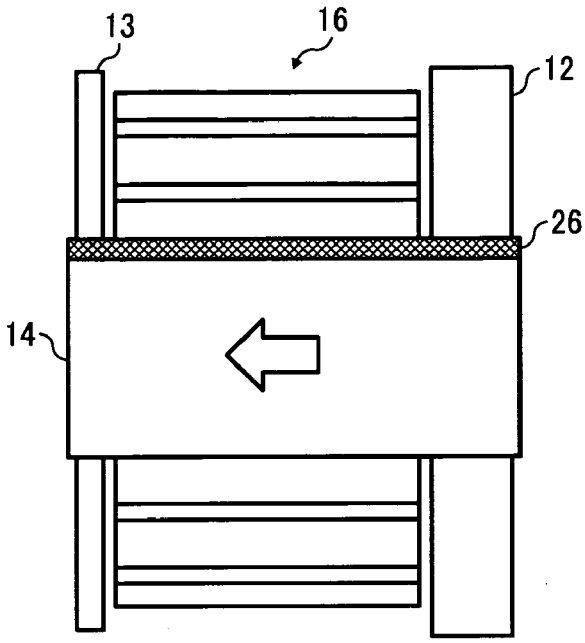
FIG. 21A is an example schematic top view illustrating a conveyance belt.
Figure 21B:
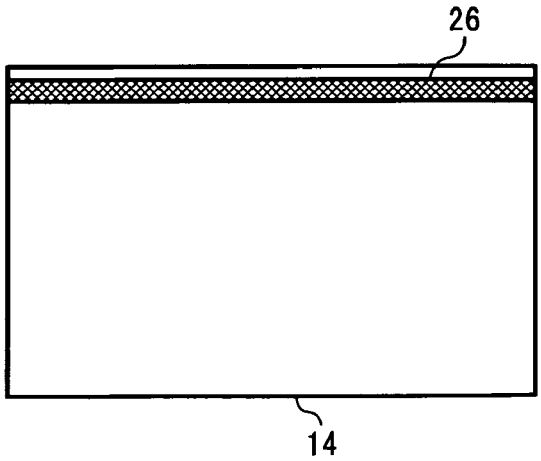
FIG. 21B is an example enlarged view illustrating a main part of the conveyance belt illustrated in FIG. 21A.
Figure 22A:
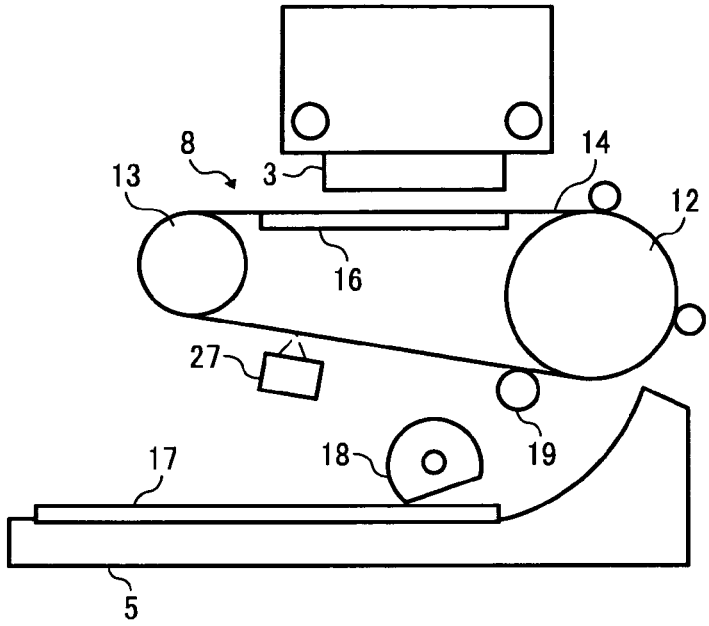
FIGS. 22A and 22B illustrate an example installation of a read sensor.
Figure 22B:
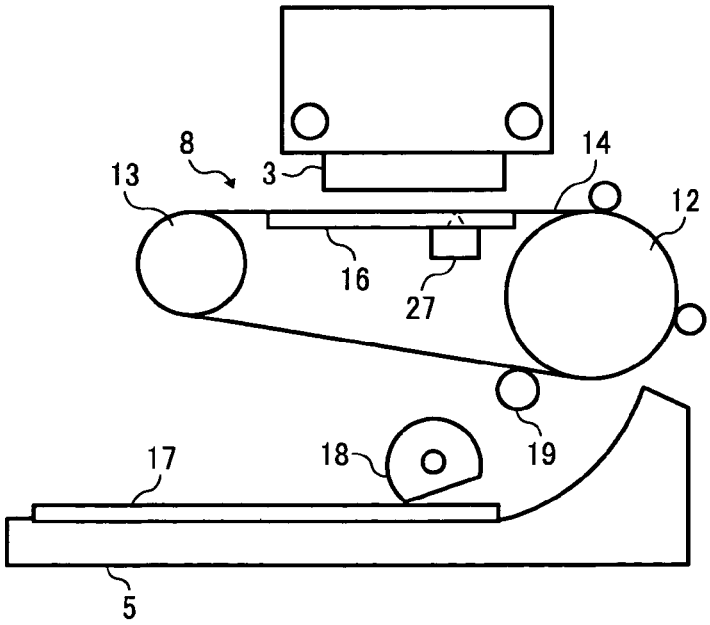

An example configuration for direct detection of the speed or amount of moving the conveyance belt 14 is illustrated in FIGS. 21A, 21B, 22A, and 22B. FIG. 21A is an example schematic top view illustrating the conveyance belt 14 and FIG. 21B is an example enlarged view illustrating a main part of the conveyance belt 14. FIGS. 22A and 22B illustrate an example installation of a read sensor. In example embodiments, an encoder 28 including a binary scale 26 illustrated in FIGS. 21A and 21B provided to a part of a front or back surface of the conveyance belt 14 with an interval determined by a highest resolution of the inkjet printer 1 and a transmission or reflective read sensor 27 disposed at a position, not interfering with the conveyance of the recording paper 17 by the conveyance belt 14 as illustrated in FIG. 22A or disposed near the printing unit as illustrated in FIG. 22B is used.

Figure 23:
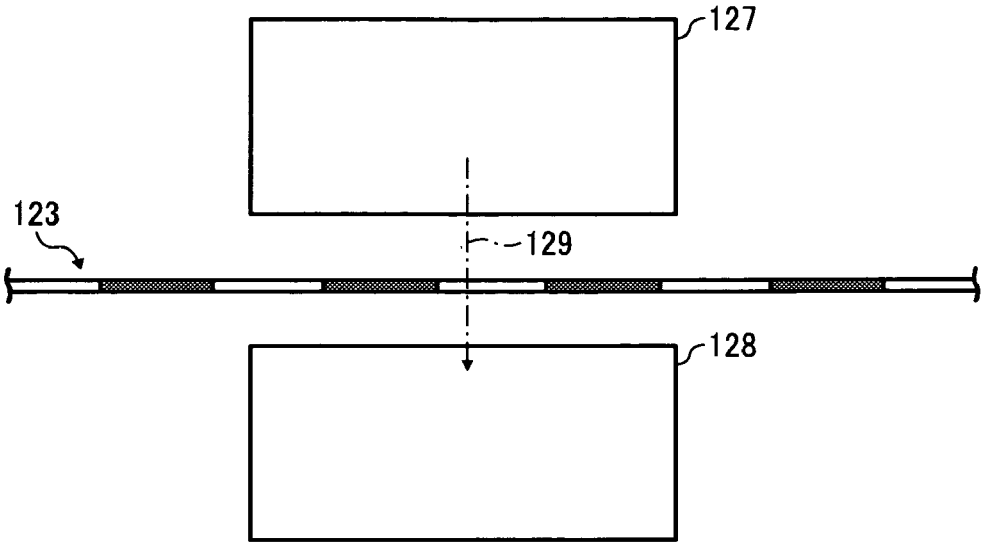
FIG. 23 is an example schematic diagram illustrating a transmission read sensor.
Figure 24:
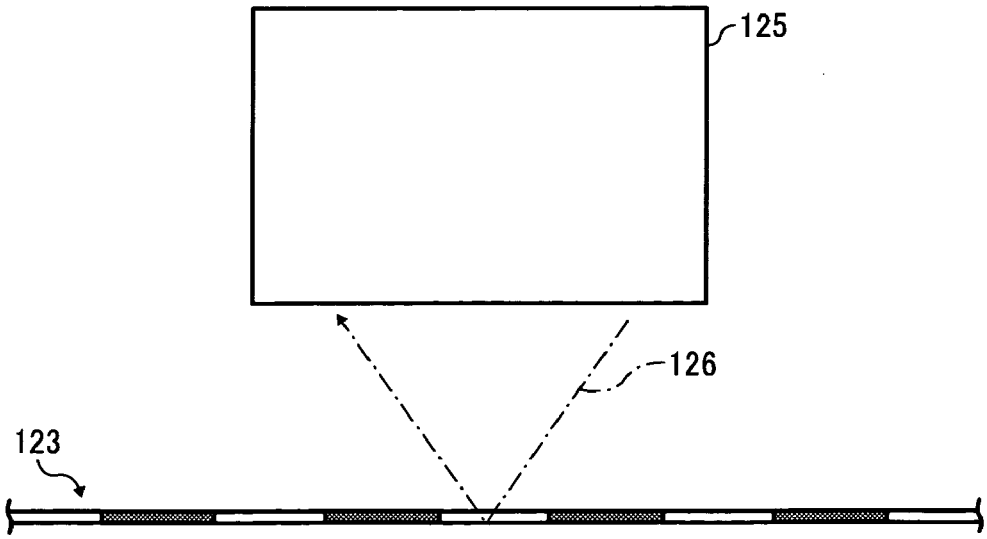
FIG. 24 is an example schematic diagram illustrating a reflective read sensor.

FIG. 23 is an example schematic diagram illustrating a transmission read sensor and FIG. 24 is an example schematic diagram illustrating a reflective read sensor.

In FIG. 23, a detection light emitter 127 emits detection light 129 to an encoder 123 and the reflected light is detected by a light receiving unit 128.

In FIG. 24, a unit 125 serving as a detection light emitter and a light receiving unit emits detection light 126 to the encoder 123 and the reflected light is detected by the unit 125.

Figure 25:
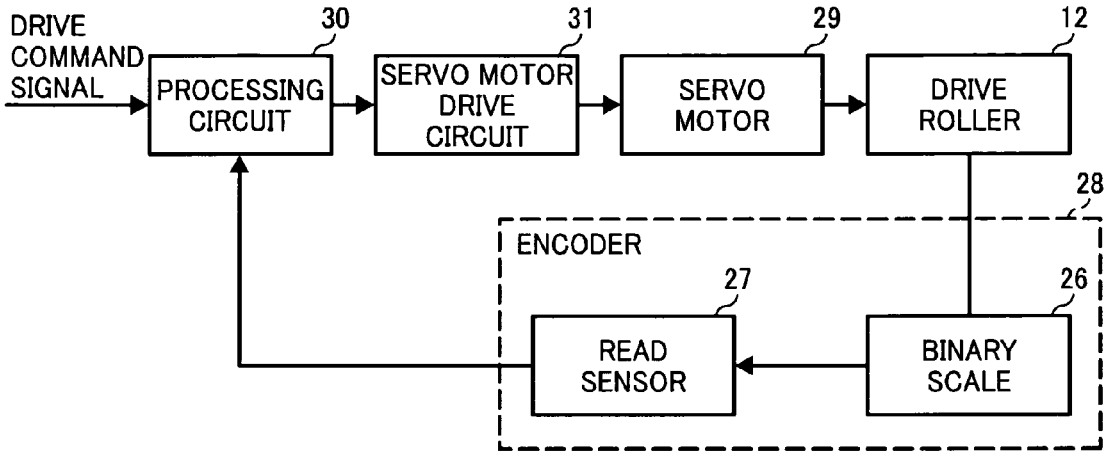
FIG. 25 is an example block diagram illustrating a drive unit.

As illustrated in a block diagram of FIG. 25, a processing circuit 30 that calculates the rotational speed of a servo motor 29 rotating the drive roller 12 receives a drive command signal and a pulse signal output from the read sensor 27. The processing circuit 30 calculates the speed of moving the conveyance belt 14 and sends a signal of the calculated speed to a servo motor drive circuit 31 that drives the servo motor 29, thereby rotating the drive roller 12 while maintaining a constant rotational speed of the servo motor 29.

By controlling the rotational speed of the servo motor 29 rotating the drive roller 12, the conveyance amount of the recording paper 17 that is attracted to and held by the conveyance belt 14 is accurately controlled.

The binary scale 26 of the encoder 28 that detects the amount of moving the conveyance belt 14 is disposed on the conveyance belt 14 and the interval of the binary scale 26 serves as a unit of accuracy of conveying the recording paper.

A minimum unit of the amount of conveying the recording paper 17 for one line during printing is determined by the highest resolution of the inkjet printer 1.

For example, when the highest resolution of the inkjet printer 1 is 1,200 dpi, the minimum unit of the amount of conveying the recording paper is 25.4 mm/1,200=21.2 μm. The interval of the binary scale 26, which is a unit of control, is 21.2 μm/n (n is an integer equal to or greater than 1). For example, when n=2, the interval of the binary scale 26 is 10.6 μm. Therefore, a shift of one pulse during control of the amount of moving the conveyance belt 14 using a pulse signal obtained from reading the binary scale 26 does not affect an image formed on the recording paper 17, thereby stably forming a high-quality image.

Figure 26:
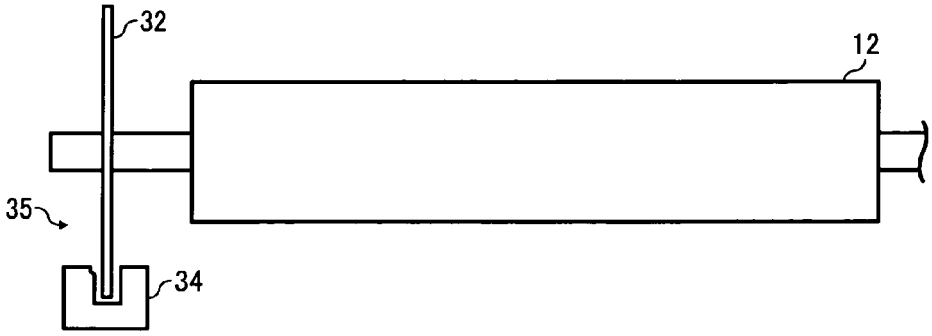
FIG. 26 is an example schematic diagram illustrating a configuration surrounding a drive roller.
Figure 27A:
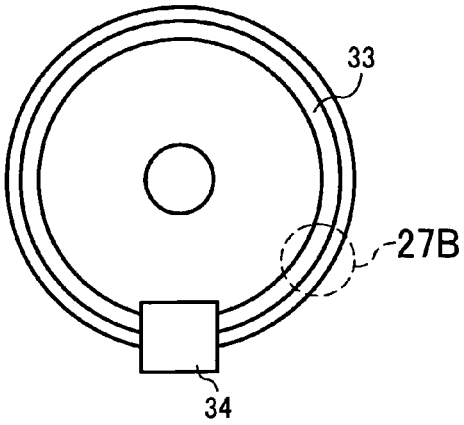
FIG. 27A is an example schematic diagram illustrating a read sensor that detects a rotation amount of the drive roller.
Figure 27B:
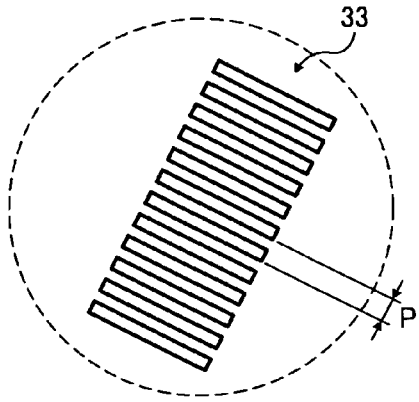
FIG. 27B is an example enlarged schematic diagram illustrating a scale.

An example configuration for indirect detection of the speed or amount of moving the conveyance belt 14 is illustrated in FIGS. 26, 27A, and 27B. In example embodiments, the speed or amount of moving the conveyance belt 14 may be calculated by detecting the rotation amount of the driven roller 12 using a rotary encoder 35 including a disk 32 disposed on a rotating shaft of the drive roller 12, a scale 33 circumferentially disposed on the disk 32 with a constant interval P, and a transmission or reflective read sensor 34 that reads the scale 33.

A scale interval P of a rotary encoder is typically, for example, 100 LPI, 150 LPI, 200 LPI, or 300 LPI.

There is a rotary encoder known for outputting a pulse four times greater than the actual scale pulse.

For example, 9,600 pulses are obtained by using the scale 33 with 2,400 lines per rotation and the read sensor 34 capable of quadrupling output.

As described above, a minimum unit of the amount of conveying the recording paper 17 for one line during printing is determined by the highest resolution of the inkjet printer 1.

For example, when the highest resolution of the inkjet printer 1 is 600 dpi, the minimum unit of the amount of conveying the recording paper is 25.4 mm/600=42.3 μm. In practice, the amount of conveying the recording paper is equal to an integral multiple of 42.3 μm.

The amount of moving the conveyance belt 14 is also determined according to the highest resolution of the inkjet printer 1.

For example, when the drive roller 12 that rotates the conveyance belt 14 is controlled based on a signal quadrupled by the rotary encoder 35 having the scale 33 with 2,400 lines per rotation, the output pulses per rotation of the rotary encoder 35 is 2,400×4=9,600 pulses.

When the highest resolution of the inkjet printer 1 is 1,200 dpi, the amount of moving the conveyance belt 14 per output pulse is 25.4 mm/1,200=21.2 μm.

The disk 32 having the scale 33 is rotated one rotation according to one rotation of the drive roller 12.

Therefore, the diameter of the drive roller 12 is 64.5 mm according to the following formula:

$$(\text{The diameter of the drive roller}\times\pi)/9{,}600=21.2\ \mu\text{m}$$

For example, the amount of moving the conveyance belt 14 per pulse is controlled to be 21.2 μm by using the drive roller 12 with the diameter of 64.5 mm and using the rotary encoder 35 having the scale 33 with 2,400 lines provided on the rotating shaft of the drive roller 12.

The amount of moving the conveyance belt 14 of 21.2 μm obtained from the highest resolution of 1,200 dpi may be output for each pulse. Alternatively, the diameter of the drive roller 12 may be obtained by dividing the amount of moving the conveyance belt 14 per pulse of the rotary encoder 35 by m (m is an integer greater than 1).

For example, when m=2, the diameter of the drive roller 12 is 32.4 mm according to the following formula:

$$(\text{The diameter of the drive roller}\times\pi)/9{,}600=10.6\ \mu\text{m}$$

The amount of moving the conveyance belt 14 per pulse is controlled to be 10.6 μm by using the drive roller 12 with the diameter of 32.4 mm and using the rotary encoder 35 having the scale 33 with 2,400 lines provided on the rotating shaft of the drive roller 12.

Therefore, a shift of one pulse during control of the amount of moving the conveyance belt 14 using the drive roller 12 does not affect an image formed on the recording paper 17, thereby stably forming a high-quality image.

Figure 28A:
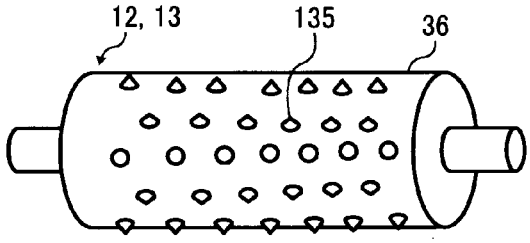
FIG. 28A is an example schematic perspective view illustrating a grip roller.
Figure 28B:
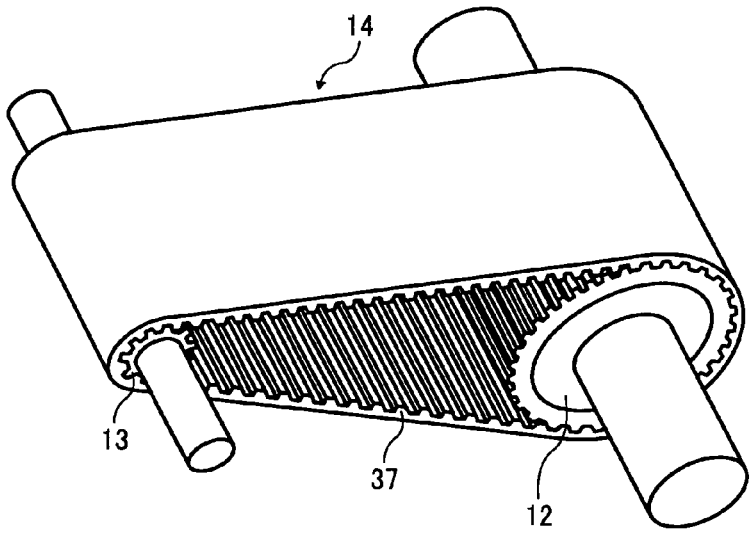
FIG. 28B is an example schematic perspective view illustrating a timing belt used as a conveyance belt.

A slippage prevention mechanism may be disposed between the drive roller 12 and the conveyance belt 14. For example, each of the drive roller 12 and the driven roller 13 or the drive roller 12 is formed of a grip roller 36 having a plurality of projections 135 thereon as illustrated in FIG. 28A, or the conveyance belt 14 is formed of a timing belt 37 as illustrated in FIG. 28B. Such a slippage prevention mechanism ensures prevention of slippage between the drive roller 12 or the driven roller 13 and the conveyance belt 14, thereby achieving accurate control of the stop position of the recording paper 17 during image formation and accurate reverse conveyance of the conveyance belt 14.

Figure 29A:
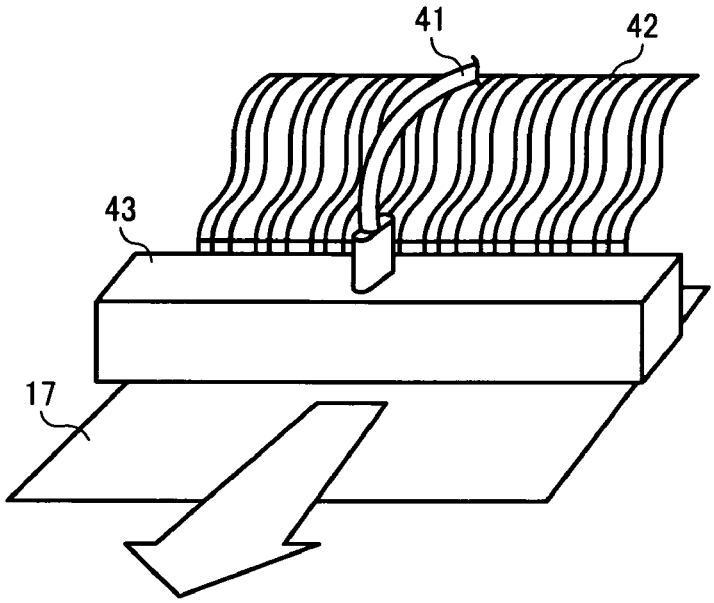
FIGS. 29A and 29B are example schematic perspective views illustrating a line head of a line type inkjet printer.
Figure 29B:
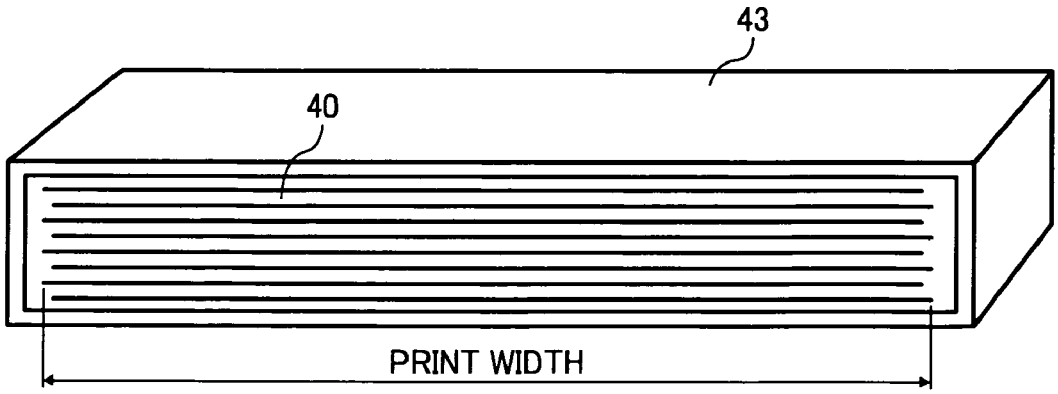
Figure 30:
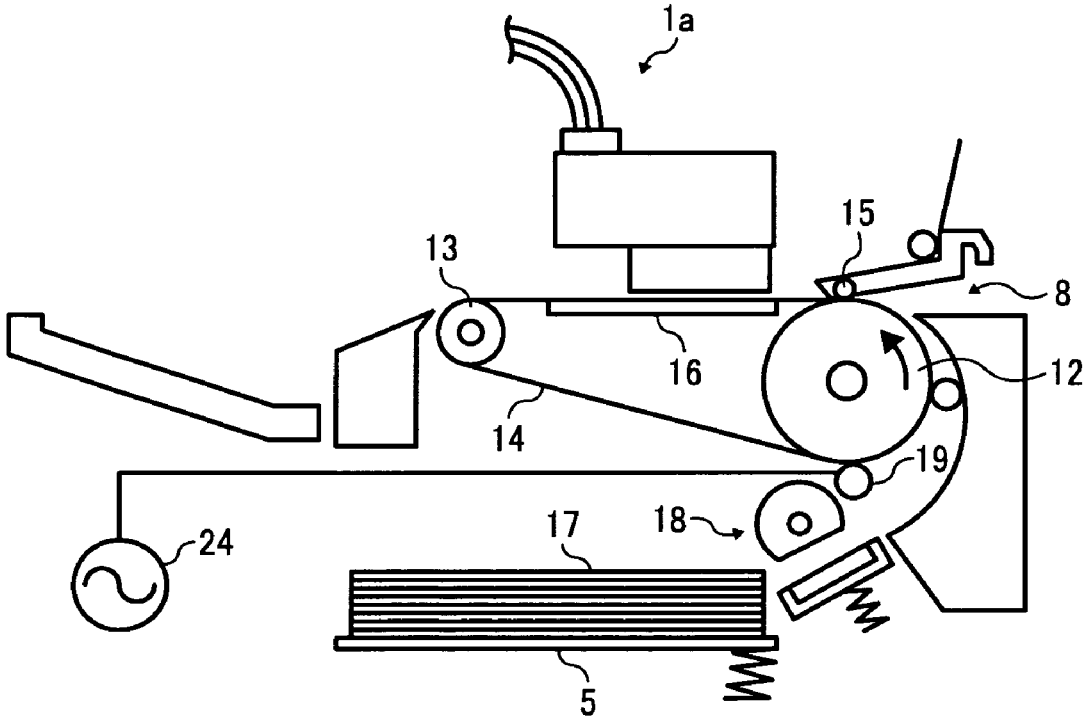
FIG. 30 is a schematic diagram illustrating an example configuration of the line type inkjet printer.

FIGS. 29A and 29B are example schematic perspective views illustrating a line head of a line type inkjet printer and FIG. 30 is a schematic diagram illustrating an example configuration of the line type inkjet printer.

It should be noted that although the above description is given of the serial-type inkjet printer 1, the recording paper conveyance unit 8 is similarly applied to the line-type inkjet printer 1*a* illustrated in FIG. 30. The line-type inkjet printer 1*a* includes a line head 43 having a nozzle array 40 extending in the width direction of the recording paper 17 over the entire width of the recording paper 17. The line head 43 pushes out ink droplets supplied by an ink supply tube 41 over the entire print width of the recording paper 17 according to a drive signal output from a head drive signal line 42. Similarly, in this case, the recording paper 17 is electrostatically attracted to and conveyed by the conveyance belt 14, thereby achieving stable conveyance of the recording paper 17 in the printing unit and stable formation of a high-quality image with improved speed accuracy of starting a new line.

It should be noted that the method to attract the recording paper is not limited to the electrostatic attraction described above. For example, the recording paper may be attached to the conveyance belt by sucking air from a suction hole provided in the conveyance belt. Alternatively, a roller may press the recording paper against the conveyance belt.

As can be understood by those skilled in the art, numerous additional modifications and variations are possible in light of the above teachings. It is therefore to be understood that, within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of example embodiments may be embodied in the form of an apparatus, method, system, computer program or computer program product. For example, the aforementioned methods may be embodied in the form of a system or device, including, but not limited to, any of the structures for performing the methodology illustrated in the drawings.

Any of the aforementioned methods may be embodied in the form of a program. The program may be stored on a computer-readable medium and adapted to perform any one of the aforementioned methods when run on a computer device (a device including a processor). The program may include computer-executable instructions for carrying out one or more of the operations above, and/or one or more of the aspects of the invention. Thus, the storage medium or computer-readable medium is adapted to store information and is adapted to interact with a data processing facility or computer device to perform the method of example embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media, for example, CD-ROMs and DVDS; magneto-optical storage media, such as MOs; magnetic storage media, including but not limited to floppy disks (trademark), cassette tapes, and removable hard disks; media with a built-in rewriteable non-volatile memory, including but not limited to memory cards; and media with a built-in ROM, including but not limited to ROM cassettes, etc. Furthermore, various information regarding stored images, for example, property information, may be stored in any other form, or provided in other ways.

Example embodiments being thus described, it will be apparent that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image forming apparatus comprising:

an image processing control unit configured to process image information received from an external device;

a carriage configured to move in a main scanning direction according to a control signal received from the image processing control unit and including a nozzle configured to discharge an ink onto a recording medium;

a conveyance unit configured to convey the recording medium in a sub-scanning direction; and a conveyance failure detection unit configured to detect a conveyance failure of the recording medium conveyed by the conveyance unit, the image processing control unit configured to determine a type of the conveyance failure among a plurality of types of conveyance failures based on recording medium information outputted from the conveyance failure detection unit and load information indicating a change in motor output, the image processing control unit configured to transmit a conveyance failure correction signal according to the determined type in order to perform an operation for retracting the carriage to a position in the main scanning direction, wherein the conveyance failure correction signal is set to repeat the operation for retracting the carriage for a number of times.

2. The image forming apparatus according to claim 1, wherein the conveyance failure correction signal is set to retract the carriage in a direction opposite to a direction of movement of the carriage at a time of the conveyance failure.

3. The image forming apparatus according to claim 1, wherein the conveyance failure correction signal is set to reverse a direction of retracting the carriage when the carriage is not retracted to the position.

4. The image forming apparatus according to claim 1, wherein the conveyance failure correction signal is set to inform a user of an occurrence of the conveyance failure after the operation for retracting the carriage is completed.

5. The image forming apparatus according to claim 1, wherein the conveyance failure correction signal is set to discharge the recording medium by the conveyance unit after the operation for retracting the carriage is completed.

6. The image forming apparatus according to claim 5, wherein a speed of discharging the recording medium is set at a speed lower than a speed of conveying the recording medium during image formation.

7. The image forming apparatus according to claim 5, wherein the recording medium is discharged while charging of the conveyance unit is turned off.

8. The image forming apparatus of claim 1, wherein the plurality of types of conveyance failures includes a first type, a second type, and a third type, the first type including a non-feed failure occurring when the recording medium is not conveyed, the second type including a size failure occurring when a size of the recording medium is different from a set size, the third type including a contact failure occurring when the carriage contacts the recording medium.

9. The image forming apparatus of claim 8, wherein if the image processing control unit determines that the type is the first type, the carriage is retracted to the position in the main scanning direction and a user is instructed to remove the recording medium, wherein if the image processing control unit determines that the type is the second type, the carriage is retracted to the position in the main scanning direction and the recording medium is automatically discharged, wherein if the image processing control unit determines that the type is the third type, the carriage is retracted in a direction opposite to the direction of movement of the carriage at a time of conveyance failure.

10. An image forming method comprising:

detecting a conveyance failure of a recording medium conveyed by a conveyance unit;

determining a type of the conveyance failure among a plurality of types of conveyance failures based on recording medium information and load information indicating a change in motor output;

transmitting a conveyance failure correction signal according to the determined type to perform an operation for retracting a carriage to correct the conveyance failure; and retracting the carriage to a position in a main scanning direction according to the conveyance failure correction signal, wherein the conveyance failure correction signal is set to repeat the operation for retracting the carriage for a number of times.

11. The image forming method of claim 10, wherein the plurality of types of conveyance failures includes a first type, a second type, and a third type, the first type including a non-feed failure occurring when the recording medium is not conveyed, the second type including a size failure occurring when a size of the recording medium is different from a set size, the third type including a contact failure occurring when the carriage contacts the recording medium.

12. The image forming method of claim 8, wherein if the determining step determines that the type is the first type, the retracting step retracts the carriage to the position in the main scanning direction, and a user is instructed to remove the recording medium, wherein if the determining step determines that the type is the second type, the retracting step retracts the carriage to the position in the main scanning direction and the recording medium is automatically discharged, wherein if the determining step determines that the type is the third type, the retracting step retracts the carriage in a direction opposite to the direction of movement of the carriage at a time of conveyance failure.

13. A non-transitory computer readable medium including computer-executable instructions, the computer-executable instructions, when executed, causing an image forming apparatus to execute:

detecting a conveyance failure of a recording medium conveyed by a conveyance unit;

determining a type of the conveyance failure among a plurality of types of conveyance failures based on recording medium information obtained from a sensor and load information indicating a change in motor output;

transmitting a conveyance failure correction signal according to the determined type to perform an operation for retracting a carriage to correct the conveyance failure; and retracting the carriage to a position in a main scanning direction according to the conveyance failure correction signal, wherein the conveyance failure correction signal is set to repeat the operation for retracting the carriage for a number of times.

14. The non-transitory computer readable medium of claim 13, wherein the plurality of types of conveyance failures includes a first type, a second type, and a third type, the first type including a non-feed failure occurring when the recording medium is not conveyed, the second type including a size failure occurring when a size of the recording medium is different from a set size, the third type including a contact failure occurring when the carriage contacts the recording medium.

15. The non-transitory computer readable medium of claim 14, wherein if the determining step determines that the type is the first type, the retracting step retracts the carriage to the position in the main scanning direction, and a user is instructed to remove the recording medium, wherein if the determining step determines that the type is the second type, the retracting step retracts the carriage to the position in the main scanning direction and the recording medium is automatically discharged, wherein if the determining step determines that the type is the third type, the retracting step retracts the carriage in a direction opposite to the direction of movement of the carriage at a time of conveyance failure.

* * * * *